US012084859B2

(12) United States Patent
Leahy

(10) Patent No.: US 12,084,859 B2
(45) Date of Patent: Sep. 10, 2024

(54) PRE-INSULATED BLOCK

(71) Applicant: Charles H. Leahy, Asheville, NC (US)

(72) Inventor: Charles H. Leahy, Asheville, NC (US)

( * ) Notice: Subject to any disclaimer, the term of this patent is extended or adjusted under 35 U.S.C. 154(b) by 234 days.

(21) Appl. No.: 17/473,527

(22) Filed: Sep. 13, 2021

(65) Prior Publication Data

US 2022/0081902 A1 Mar. 17, 2022

Related U.S. Application Data

(60) Provisional application No. 63/078,034, filed on Sep. 14, 2020.

(51) Int. Cl.

| | |
|---|---|
| ***E04C 1/41*** | (2006.01) |
| ***E04B 2/02*** | (2006.01) |
| ***E04B 2/16*** | (2006.01) |
| ***E04B 2/26*** | (2006.01) |

(52) U.S. Cl.

CPC ..... *E04C 1/41* (2013.01); *E04B 2/16* (2013.01); *E04B 2/26* (2013.01); *E04B 2002/0206* (2013.01); *E04B 2002/0289* (2013.01)

(58) Field of Classification Search

CPC ..... E04C 1/41; E04C 1/40; E04B 2/16; E04B 2/26; E04B 2002/0206; E04B 2002/0289; E04B 2002/0247

See application file for complete search history.

(56) References Cited

U.S. PATENT DOCUMENTS

| | | | | |
|---|---|---|---|---|
| 4,614,071 | A * | 9/1986 | Sams | E04C 1/41 52/591.4 |
| 5,701,710 | A * | 12/1997 | Tremelling | E04B 2/8635 52/592.1 |
| 5,934,037 | A * | 8/1999 | Bundra | E04B 2/08 52/603 |
| 6,205,726 | B1 | 3/2001 | Hoadley | |
| 7,882,674 | B2 | 2/2011 | Craven et al. | |
| 8,397,465 | B2 | 3/2013 | Hansbro et al. | |
| 8,448,396 | B2 * | 5/2013 | Robertson | B32B 38/0036 52/794.1 |
| 8,549,808 | B2 | 10/2013 | Badin | |
| 8,869,492 | B2 * | 10/2014 | Leahy | E04C 2/521 52/592.1 |
| 8,893,450 | B2 | 11/2014 | Zohar | |
| 9,689,160 | B2 | 6/2017 | Lanese | |
| 10,113,305 | B2 | 10/2018 | Radford | |

(Continued)

FOREIGN PATENT DOCUMENTS

| | | | |
|---|---|---|---|
| CN | 107060194 | A | 8/2017 |
| CN | 111456320 | A | 7/2020 |
| EP | 2722455 | A1 | 4/2014 |
| KR | 101509035 | B1 | 4/2015 |

OTHER PUBLICATIONS

International Search Report and Written Opinion dated Jan. 7, 2022 issued by the International Application Division, Korean Intellectual Property Office as International Searching Authority in connection with International Application No. PCT/US2021/050251 (10 pages).

*Primary Examiner* — Rodney Mintz
(74) *Attorney, Agent, or Firm* — NEO IP

(57) ABSTRACT

An insulated block includes two sides and a self-adhering foam core joined to the two sides during the curing of the foam core. The foam core includes protrusions and recessions to facilitate joining of each insulated block with another insulated block. The insulated block is configured to be joined to other insulated blocks to create a structure or foundation which does not require mortar.

20 Claims, 15 Drawing Sheets

(56) References Cited

U.S. PATENT DOCUMENTS

| | | | | |
|---|---|---|---|---|
| 10,273,685 | B2 | 4/2019 | Martinez | |
| 10,301,820 | B2 | 5/2019 | Browning et al. | |
| 10,626,599 | B2 | 4/2020 | Negev | |
| 10,941,571 | B2 * | 3/2021 | Wasniewski | E04B 1/66 |
| 11,408,173 | B2 * | 8/2022 | Fermanian | E04B 2/26 |
| 2002/0157334 | A1 | 10/2002 | Smith | |
| 2004/0040234 | A1 | 3/2004 | Davison et al. | |
| 2014/0053481 | A1 * | 2/2014 | Leahy | E04B 1/34321 52/270 |
| 2014/0123583 | A1 * | 5/2014 | Arriola Serrano | E04C 1/397 52/405.1 |
| 2017/0191266 | A1 | 7/2017 | Androsiuk | |
| 2020/0048903 | A1 * | 2/2020 | Wasniewski | E04C 1/40 |
| 2021/0156147 | A1 * | 5/2021 | Fermanian | E04B 2/18 |
| 2021/0189723 | A1 * | 6/2021 | Lakatos | E04B 2/08 |
| 2022/0064941 | A1 * | 3/2022 | Bowers | E04B 2/18 |
| 2022/0074204 | A1 * | 3/2022 | Gray | E04B 2/08 |

* cited by examiner

PRE-INSULATED BLOCK

This application claims priority to and the benefit of U.S. Provisional Application No. 63/078,034, filed Sep. 14, 2020, which is incorporated by reference in its entirety.

BACKGROUND OF THE INVENTION

1. Field of the Invention

The present invention relates to insulated building materials, and more specifically to pre-insulated blocks.

2. Description of the Prior Art

It is generally known in the prior art to provide building materials with insulation.

Prior art patent documents include the following:

U.S. Pat. No. 6,205,726 for Insulated masonry block and wall by Hoadley, filed May 5, 1999 and issued Mar. 27, 2001, is directed to an insulated concrete block and wall assembly. The primary element is an insulated block which consists of two rectangular concrete facings and a rigid solid insulating core. The concrete facings are attached by adhesive to the insulating core. The insulating core has apertures within it to allow vertical reinforcing rod support in a constructed wall. The invention additionally provides an indentation along the top of each insulating core to provide for horizontal re-rod support within the wall itself. The invention provides optimal decrease in thermal conductivity coupled with simplicity of design and transport.

U.S. Pat. No. 8,549,808 for Structural element for the building trade by Badin, filed May 21, 2009 and issued Oct. 8, 2013, is directed to a structural element for use as a brick, construction block, panel, floor or suchlike in the building trade, comprises at least one part made of conglomerate material, such as concrete and suchlike, to which an insert made of insulating or filling material is constrained, to define peripherally at least a connection face for connection to another structural element, the connection face has visible a first surface of the insert and at least a connected second surface of the part made of conglomerate material. On the connection face one or more other structural elements are able to be combined, along a support plane provided in correspondence with the connection face, so as to be laid and stably connected by means of a layer of binder material. The second surface has a seating made longitudinally and lowered with respect to the support plane on which seating the layer of binder material is located. The seating has a determinate depth, with respect to the support plane. The depth is correlated to the predefined thickness of the binder material to be laid.

U.S. Pat. No. 10,113,305 for Load bearing interlocking structural blocks and tensioning system by Radford, filed Jul. 31, 2015 and issued Oct. 30, 2018, is directed to construction materials intended for use as structural elements, such as structural blocks, used in the construction of buildings and civil engineering structures. The blocks can comprise hemp hurd and fibers, flax fiber, hydraulic lime and hydrated lime. In one aspect, the blocks may comprise a body shape configured so as to allow it to interlock with other blocks in the construction of a structure. In another aspect, the blocks may be adapted to incorporate tensioning means. Methods for manufacturing the blocks and structures comprising such materials and methods for building such structures are also disclosed.

U.S. Pat. No. 8,893,450 for Methods and devices for making a building block for mortar-free construction by Zohar, filed Mar. 4, 2012 and issued Nov. 25, 2014, is directed to devices and methods for using building blocks for construction that does not require mortar, internal columns or additional internal or external finishing. A building block includes joining elements for attaching blocks from top to bottom as well as from side to side. Additionally, blocks have internal and external finishes that are complete. The block includes a removable face for allowing access to space for infrastructural elements like wires and pipes. Thus, after construction of a structure, there is no additional need to paint, hang wallpaper or otherwise treat the outer and inner walls of the final structure.

U.S. Pat. No. 9,689,160 for Reusable module for manufacturing at least one portion of a repeatedly dismountable wall of a construction by Lanese, filed Dec. 4, 2013 and issued Jun. 27, 2017, is directed to a dismountable module for manufacturing at least one portion of a repeatably dismountable wall of a construction, the module comprising: a first body adapted to define an outer surface of said wall, at least one structural member adapted to withstand the loads generated by the wall; the structural member comprises a main body elongated along a first axis, arranged vertically in use, and a thickening protruding from said main body transversally to said first axis; the thickening defines a first face and a second face opposite to the first face and adapted to cooperate, either directly or indirectly, with a further module, superimposable on said module according to said first axis, so as to transfer a load from the further module to said structural member.

US Patent Publication No. 2014/0123583 for Block for construction and method of construction with said block by Serrano, filed Jun. 7, 2012 and published May 8, 2014, is directed to a block for construction formed by two outer plates of identical or different finish materials, between which there is included an intermediate core formed by one or several layers of insulating materials, said intermediate core being tucked in according to recesses with respect to the plates on at least one edge of the contour and projecting in a reciprocal manner according to projections on at least another edge of the contour.

U.S. Pat. No. 10,626,599 for Interlocking masonry brick by Negev, filed Jan. 4, 2017 and issued Apr. 21, 2020, is directed to a thermal and moisture insulated interlocking brick comprising natural, in-situ carved stone façade coupled to a backing layer comprised of a massive and lightweight portions, as well as methods of forming the brick and methods for cladding and using the bricks in load bearing walls and in non-load-bearing walls (light construction).

US Patent Publication No. 2004/0040234 for Constructional element, building system and method of construction by Davison, et al., filed Oct. 9, 2001 and published Mar. 4, 2004, is directed to a constructional element, building system and method of construction. The building system and method of construction utilise the constructional element. The construction element is elongate and includes a hollow structural member and cladding formed about at least part of the structural member. Abutment means are formed in at least part of the cladding's perimeter for mutual abutment and alignment with abutment means on an adjacent constructional element. At least one end of the structural member protrudes from the cladding. A building system and method of construction are also disclosed, both of which utilise the constructional element.

US Patent Publication No. 2017/0191266 for A self-bearing prefabricated construction element and a method of erecting external building walls of prefabricated construction elements by Androsiuk, filed Jun. 1, 2016 and published Jul. 6, 2017, is directed to a self-bearing prefabricated construction element for erecting external walls in buildings, composed of external and internal panels integrated with the insulating material which goes in between, characterized in that the external panel (1) forms the face of architectural concrete which serves as the facade finishing layer, and the internal panel (2) is preferably made of structural concrete, where the insulation (3) in between the panels and integrated therewith is made of a foam material of density ranging from 10 kg/m3 to 55 kg/m3 and features at least two slots (4) in the vertical side zones.

U.S. Pat. No. 10,301,820 for Insulated concrete masonry system by Browning, et al., filed Aug. 29, 2018 and issued May 28, 2019, is directed to an insulated masonry wall system having insulation blocks between structural and face blocks to provide structures that are strong, inexpensive, avoid thermal bridges, and resist transmission of heat. The walls are attractive and versatile, and an enormous variety of decorative face members may be utilized. The face blocks are attached to the structural blocks to prevent facing materials from falling even if fire destroys the insulation blocks between the structural blocks and the facing. The system resists water penetration and effectively drains water that does penetrate any portion of the system.

U.S. Pat. No. 10,273,685 for Block interlocking module and system to build architectural structures by Martinez, filed Sep. 17, 2018 and issued Apr. 30, 2019, is directed to an interlocking module including a panel and one or more trapezoidal elongations extending from any of the first end face, the second end face, the first side face, the second end face, the upper face or the lower face of the panel, wherein the one or more trapezoidal elongations each include a dovetail joint. The interlocking module further including one or more members, wherein each of the one or more members emanates from each of the one or more trapezoidal elongations, and wherein each of the one or more members emanates in a perpendicular direction relative to each of the upper and the lower faces of the panel. The upper face includes a plurality of apertures, wherein each of the plurality of apertures is configured for receiving a pin from a member of a second module for interlocking the second module and a first module. The panel and the one or more members of the interlocking module define a void space for receiving a standard sized building block within the void space.

U.S. Pat. No. 7,882,674 for Building blocks and wall assembly utilizing same by Craven, et al., filed Dec. 8, 2006 and issued Feb. 8, 2011, is directed to molded concrete building blocks consisting of three block walls and block webs so located as to provide an increased path through the width of the block to reduce transmission of thermal and acoustic energy. The blocks may incorporate features, e.g., male projections and female recesses or an offset inner wall, so that mortar may not be required for assembly. The blocks may be configured so that interior apertures may be vertically aligned when the blocks are assembled in courses, providing adaptability to structure enhancing reinforcement and insulation materials, and to interior wall installation of wiring and plumbing.

SUMMARY OF THE INVENTION

The present invention relates to insulated blocks for use in building structures.

It is an object of this invention to provide self-aligning blocks which provide a physical, thermal, moisture, vapor, air, and fire barrier.

In one embodiment, the includes an insulated block including a first side including a first material, a second side including a second material, a core including a thermoset, a tongue component, and a groove component, wherein the first side and the second side are adhesively bonded to the thermoset core, and wherein the groove component is configured to receive a tongue component from a second insulated block.

In another embodiment, the present invention includes an insulated block including a first side including concrete, a second side including a composite material, and an insulating core including at least one protrusion and at least one recession, wherein the first side and the second side are adhesively bonded to the insulating core, and wherein the at least one recession is configured to receive at least one protrusion from a second insulated block.

In yet another embodiment, the present invention includes an insulated block including a first side, a second side, and an insulating core including at least one protrusion, at least one recession, and at least one interior chase, wherein the first side and the second side are adhesively bonded to insulating core, wherein the at least one recession is configured to receive at least one protrusion from a second insulated block, wherein the interior chase is configured to receive a structural support, wherein the interior chase is positioned substantially central between the first side and the second side, and wherein the insulating core includes at least one multi-laminar edge, wherein the multi-laminar edge includes a male component and a female component, wherein the female component is configured to receive a male component of a second insulated block.

These and other aspects of the present invention will become apparent to those skilled in the art after a reading of the following description of the preferred embodiment when considered with the drawings, as they support the claimed invention.

DETAILED DESCRIPTION

Figure 1:
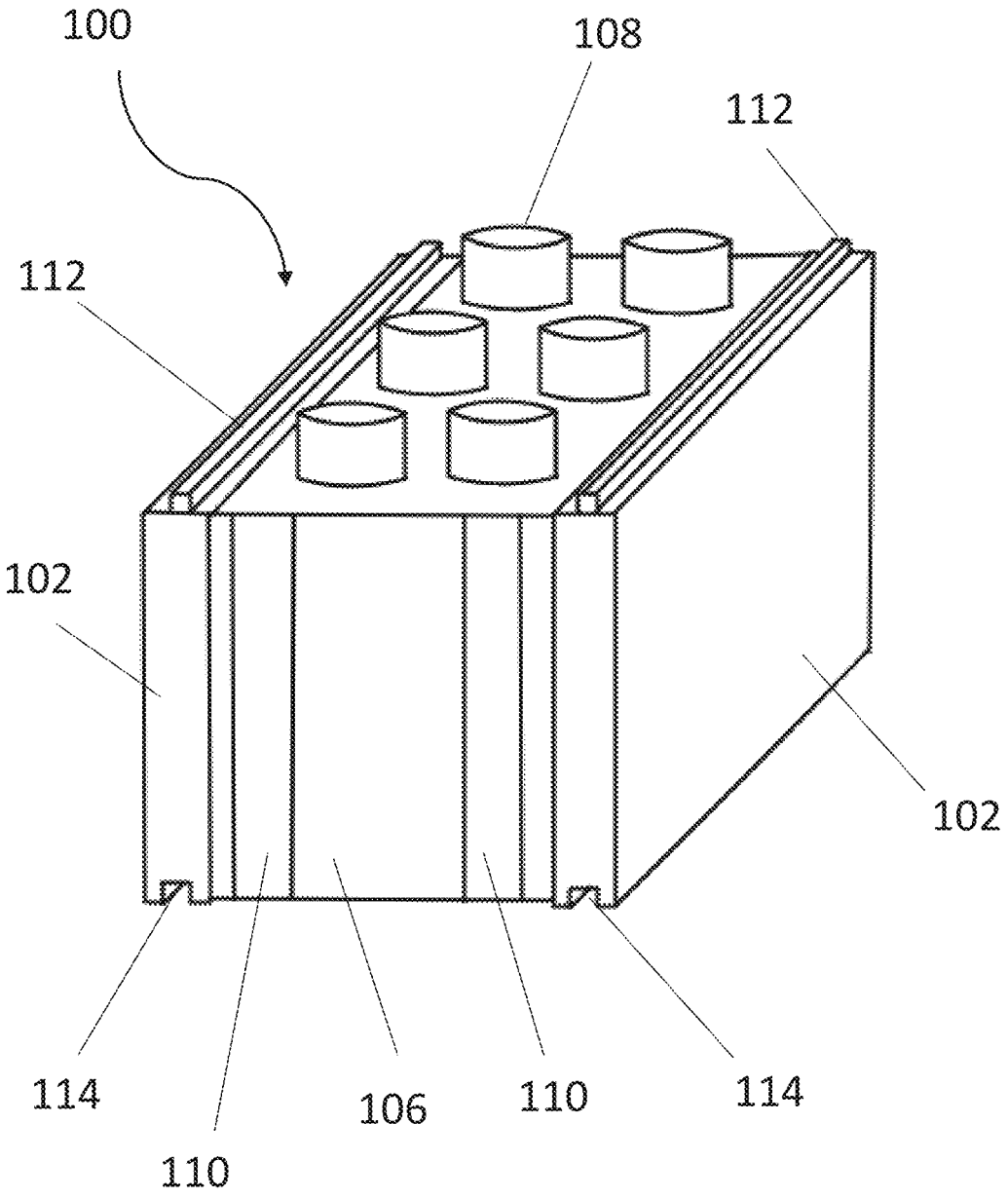
FIG. 1 illustrates a side perspective view of an insulated block with siding including tongue and groove components according to one embodiment of the present invention.

The present invention is generally directed to insulated blocks for use in construction of structures.

In one embodiment, the includes an insulated block including a first side including a first material, a second side including a second material, a core including a thermoset, a tongue component, and a groove component, wherein the first side and the second side are adhesively bonded to the thermoset core, and wherein the groove component is configured to receive a tongue component from a second insulated block.

In another embodiment, the present invention includes an insulated block including a first side including concrete, a second side including a composite material, and an insulating core including at least one protrusion and at least one recession, wherein the first side and the second side are adhesively bonded to the insulating core, and wherein the at least one recession is configured to receive at least one protrusion from a second insulated block.

In yet another embodiment, the present invention includes an insulated block including a first side, a second side, and an insulating core including at least one protrusion, at least one recession, and at least one interior chase, wherein the first side and the second side are adhesively bonded to insulating core, wherein the at least one recession is configured to receive at least one protrusion from a second insulated block, wherein the interior chase is configured to receive a structural support, wherein the interior chase is positioned substantially central between the first side and the second side, and wherein the insulating core includes at least one multi-laminar edge, wherein the multi-laminar edge includes a male component and a female component, wherein the female component is configured to receive a male component of a second insulated block.

None of the prior art discloses an insulated block including siding joined with a polyurethane foam core without a separate adhesive, wherein the polyurethane foam includes protrusions and recessions such that insulated blocks are configured to be self-aligning with other blocks when joined together, thereby providing for interlocking of blocks without the need for a chemical agent to attach blocks together or any other physical means of attachment or connection between blocks for the interlocking of blocks.

The use of concrete in building projects has come under increased scrutiny as the world begins to look toward more sustainable products. Concrete has traditionally offered little insulating value and the industry necessary to produce concrete products has been a major contributor to carbon emissions.

The United States Department of Energy has stated that one of the greatest opportunities to reduce carbon emissions is through improved insulation. Concrete, in the form of concrete masonry units (CMUs) represent one of the most common construction materials across the world. Builders utilize concrete to create strong structures capable of withstanding both fire and high wind. Traditional methods for the creation of concrete block walls involve the injection of foam into the cavities of concrete blocks or the addition of layers of insulation to the outside of the walls. Each of these methods requires a significant amount of additional materials and labor.

In response to the issues faced by traditional concrete, autoclaved aerated concrete (AAC) is sometimes used. AAC possesses small air pockets within each block, increasing the insulating efficiency, but still requiring large amounts of the AAC material, in excess of 10 to 20 inches in thickness, in order to match the insulating efficiency of other materials. Additionally, AAC can still wick moisture through the walls in a manner similar to traditional concrete.

Another attempt to respond to the problems posed by traditional concrete is insulated concrete foam (ICF). Construction using ICF begins by placing interior and exterior layers of insulation with a hollow interior between the layers. Concrete is then poured in the cavity between the layers and cured. However, ICF poses additional challenges. For example, if too much concrete is poured into the cavity at one time, it may cause blowout due to the low strength of the insulation layers. Additionally, as the concrete is disposed between the insulation layers, the thermal mass of the concrete is unable to provide considerable benefit for an interior occupant due to the insulation between the occupant and the concrete mass inherent in the system.

Traditional concrete masonry walls provide structure but not insulation, and the insulation has to be added later after the stacking and joining blocks typically with mortar at the joints, along with possibly a vapor barrier or finishing surface. These blocks must be stacked, aligned, and joined with mortar, and a vapor barrier or other type of desired barrier, such as a fire barrier or moisture barrier, must be applied. This process creates thermal inefficiencies in the building structure by requiring mortar to cure and join together blocks, which leaves openings where heat can pass through the blocks. Additionally, concrete or cement in and of itself is not a thermally efficient material for structures. Furthermore, assembly of concrete blocks or cinder blocks requires a skilled mason.

While certain attempts have been made to improve upon this traditional method of building structures or foundations for structures, these attempts still fall short of the long-felt, unmet need of providing an energy efficient assembly which provides a physical, thermal, moisture, vapor, air, and fire barrier, that is readily assembled by a lay person or construction worker, and provides customizability in terms of the interior and exterior siding for a structure or foundation. Currently, many insulated concrete forms (ICFs) include polystyrene foam on the outside of the ICFs, or physically and/or chemically join polystyrene foam with siding. Including foam on the outside of a building material is disadvantageous because it exposes the foam to external elements, which can cause damage in the event of fire or another destructive event.

The present invention solves these issues with the prior art by providing an insulated block which includes an exterior siding and an interior siding joined together via a closed cell foam core, wherein the exterior siding and the interior siding are joined together with the closed cell foam core as the closed cell foam core cures. This advantageously provides for a strong bond between the foam core and the sides of the block without requiring a separate adhesive or any other means of physical or chemical attachment between the foam core and the sides of the block. Additionally, the block including the foam core is cured in a mold or form which provides for protrusions and recessions to be formed in the foam core, thereby creating a block which is self-aligning with other blocks via the protrusions and recessions. The edges of the foam core are also multi-laminar, which facilitate joining of the side of one block with a side of another block when assembling a structure or a foundation of a structure. In some embodiments, the insulated blocks include multi-laminar edges as described in U.S. Provisional Patent Application No. 62/994,606, titled "HIGH-R VALUE INSULATED BUILDING PANEL WITH INTEGRATED WEATHER RESISTANT BARRIER", and U.S. Pat. No. 8,869,492, titled "Structural building panels with interlocking seams" each of which is incorporated herein by reference in its entirety.

Referring now to the drawings in general, the illustrations are for the purpose of describing one or more preferred embodiments of the invention and are not intended to limit the invention thereto.

FIG. 1 illustrates a side perspective view of an insulated block with siding including tongue and groove components according to one embodiment of the present invention. The insulated block 100 includes sides or siding 102 and a foam core 106. The sides 102 are configured to be constructed out of any structural material known in the art, such as concrete, wood, brick, a composite material such as oriented strand board (OSB), plywood, lumber, timber, stone, rock, and/or metal such as steel, copper, titanium, etc. Preferably, the sides 102 are constructed out of a rigid material. In one embodiment, both of the sides 102 are constructed out of the same material. Alternatively, the sides 102 are constructed out of different materials. By constructing the sides 102 out of different materials, the present invention advantageously provides for construction of a structure with an appropriate exterior wall and an appropriate interior wall without requiring additional layers or components. For example, one side 102 is constructed out of concrete and is utilized as the exterior side for a structure, and the other side 102 is constructed out of OSB and is used as an interior side for a structure. This enables a structure to be built quickly, as no masonry or additional adhesive is required to keep blocks joined together. However, in another embodiment, adhesive including clay, cement, acrylic resin, polyurethane monomers, and/or styrene-butadiene rubber or similar gasketing materials of sufficient load bearing and shock-absorbing capacity is utilized to adhere or space blocks together for additional stability. In yet another embodiment, each block includes a pre-applied adhesive on at least one surface, such as the sides, the protrusions, and/or the top surface of the core below the protrusions. In some embodiments, the pre-applied adhesive is covered with peelable laminate, such that the pre-applied adhesive is exposed only at the time the blocks are to be stacked and joined together. In some embodiments, the peelable laminate includes cellophane.

In one embodiment, a side 102 intended as an interior side of a structure or wall includes a significantly thicker mass than the side 102 intended as an exterior side of a structure or wall. Advantageously, this makes the insulated block 100 stronger in compressive loading and also provides for the side 102 intended as an interior side of a structure or wall to act as a "thermal mass," releasing stored thermal energy after internal heating, ventilation, and air conditioning (HVAC) systems have been turned off. This helps increase the energy efficiency of a structure as well as comfort within the structure, and provides a method of passive energy exchange within the structure. In other embodiments, a side 102 intended as an exterior side includes a significantly thicker mass than the side 102 intended as an interior side of a structure or wall. A relatively thicker exterior side allows the exterior side of a wall to act as the primary load bearer for a structure, which is desirable in some cases.

The sides 102 preferably include finished outer surfaces and rougher inner surfaces. The rougher inner surfaces facilitate bonding with the foam core 106, as rougher inner surfaces include more surface area than smooth or finished surfaces, thereby providing an increased surface area to which the foam can adhere. An increased surface area creates more locations with which the foam will bond. In one embodiment, a roughened inner layer is adhered or otherwise physically or chemically joined to the interior of a side 102 to facilitate bonding of the polyurethane foam to the roughened inner layer as the foam cures. As the foam is injected or poured into a space defined by the sides 102 and a mold or form, the foam completely fills this space and completely or substantially completely bonds with the inner surfaces of the sides 102. In other words, the foam completely fills the space between the two sides 102 except for recessions in the bottom of the foam core 106. In one embodiment, the surface roughness of the inner surfaces is greater than the surface roughness of the outer surfaces as measured in accordance with ISO 4287:1997 (April 1997), which is hereby incorporated herein by reference in its entirety. Alternatively, a rough surface includes a greater friction coefficient than a smooth or finished surface. In one embodiment, the inner surfaces of the sides 102 are roughened by creating grooves in the inner surfaces, by not finishing the inner surfaces, or through any other method known in the art.

The sides 102 each include at least one tongue 112 on the top surface of the sides 102 and at least one corresponding groove 114 on the bottom surface of the sides 102. The tongue 112 and groove 114 facilitate joining of the insulated block 100 with another block. In one embodiment, the bottom block in a wall or structure does not include grooves 114 on the sides 102. The tongues 112 are preferably integrally formed with the sides 102 and mortar or any other adhesive is not used to join the tongues 112 to the sides 102. Alternatively, the tongues 112 are joined with the sides 102 via chemical and/or mechanical attachment, such as fasteners, adhesive, mortar, etc. In one embodiment, a gasket is utilized to facilitate joining of the tongues 112 of one block with the grooves 114 of another block. The gasket is configured to fit around the tongues 112 and is constructed out of polyurethane foam in one embodiment.

The sides 102 are adhered to the foam core 106 to create the insulated block 100. The top of the foam core 106, excluding the protrusions 108, is operable to be flush with top edges of the sides 102 from which the tongues 112 protrude. Alternatively, the top of the foam core 106 is operable to be recessed below the sides 102. Significantly, the foam core 106 includes protrusions 108 and recessions for receiving protrusions from another block. These protrusions are cylindrical in one embodiment. Alternatively, the protrusions are any shape, such as rectangular, triangular, pentagonal, hexagonal, etc. In one embodiment, the protrusions are larger towards the edges of the block to provide additional structural strength closer to the seams where the blocks join together. The protrusions 108 are substantially evenly spaced in FIG. 1, but are configured to be spaced or arranged in any configuration and in any number. The foam core 106 is preferably constructed out of a thermoset, such as a closed cell polyurethane foam. By utilizing a closed cell polyurethane foam, the block is configured to be assembled by securing the sides 102 around a void defined by the sides 102 and a mold or form for the closed cell polyurethane foam, pumping the closed cell polyurethane foam into the void, allowing the closed cell polyurethane foam to cure, and removing the mold or form. The closed cell polyurethane foam of the present invention adheres to the sides 102 as the closed cell polyurethane foam cures, thereby providing for a strong bond between the foam core 106 and the sides 102. In one embodiment, the closed cell polyurethane foam has a density between 2.2-2.4 lb/ft$^3$, a compressive strength of 35 psi, a tensile strength of 58 psi, a thermal resistance per one inch of thickness at 75 deg. F. of approximately 6.9° F.*ft$^2$/Btu, a thermal resistance per one inch of thickness at 20 deg. F. of 8.0° F.*ft$^2$/Btu, a water vapor permeance of approximately 0.688 gr/ft2/hr/inHg, is fire retardant, and chars at 800° F. In one embodiment, the foam includes a density of 2.40 lbs/ft$^3$, a volume of approximately 0.3 ft$^3$, and a weight of approximately 0.76 lbs. Preferably, the density of the foam is greater than 2.00 lbs/ft$^3$ to enable the block 100 to withstand the forces of compression, shear and transverse loading for the blocks individually and when stacked together with other blocks.

The foam core 106 also includes multi-laminar edges 110 to facilitate joining the block 100 with other blocks. The multi-laminar edges 110 are configured to connect with edges of another corresponding block to provide friction-based locking of the insulated block 100 with another insulating block. In one embodiment, the multi-laminar edges 110 are vertical, rectangular shaped protrusions on the side of the insulated block 100, wherein the vertical rectangular shaped protrusions are configured to engage via friction-based locking with recessions on the side of another insulated block. In one embodiment, the rectangular shaped protrusions are tongues and the recessions are grooves. Advantageously, the present invention is operable to include multiple tongues and grooves to increase the surface area of the joint across the same dimension, which increases the friction for opposing forces and creates a stronger structure. Accordingly, in one embodiment, the insulated block 100 includes two tongues on a first side of the foam core 106 and two corresponding grooves on the opposite side of the foam core 106, three tongues on a first side of the foam core 106 and three corresponding grooves on the opposite side of the foam core 106, four tongues on a first side of the foam core 106 and four corresponding grooves on the opposite side of the foam core 106, five tongues on a first side of the foam core 106 and five corresponding grooves on the opposite side of the foam core 106, or any number of tongues on a first side of the foam core 106 and corresponding grooves. Alternatively, the sides of the foam core 106 of the insulated block 100 includes protrusions and recessions analogous to the protrusions 108 and recessions on the top and bottom of the foam core 106, respectively. The protrusions are operable to be any shape and size and present in any number and configuration on the side of the foam core 106. Additionally or alternatively, protrusions and corresponding recessions are included in the sides 102 to facilitate joining of multiple insulated blocks from the side. In one embodiment, the sides 102 and/or the foam core 106 include integrated knock down compressing fasteners such as cam locks described in U.S. Pat. No. 8,869,492, titled "Structural building panels with interlocking seams", which is incorporated herein by reference in its entirety. Other mechanisms for joining sides of blocks together include any other physical or chemical methods of attachment or bonding known in the art, including by way of example and not limitation, adhesive, hook and loop tape such as VELCRO®, etc. Furthermore, insulated blocks are configured to be joined together by an anchor rod inserted through or glued to the concrete of each insulated block.

Notably, the insulated block is configured to be any size. For example, the insulated block is approximately the size of a standard cinderblock or a standard brick in on embodiment. By way of example and not limitation, the insulated block is approximately 13 inches long by 8 inches tall by 8.5 inches wide.

The insulated block includes a foam core having an R value of approximately R7 per inch of thickness. Accordingly, the foam cores of the present invention exhibit R values as high as R72 and higher as measured by varying environmental conditions. R values are the effective thermal resistance of the insulated block. As the R value of the siding is often negligible, the effective R value of the insulated block is typically determined or estimated by the R value of the foam. In another embodiment, the block includes an R-value between R25 and R72. In other embodiments, the block includes an R-value greater than R72. The foam core also helps to prevent air leakage in a building. Advantageously, the foam insulation is formulated to increase in R value as temperature decreases, thereby, increasing thermal resistance and energy efficiency as the temperatures drops. Alternatively, the insulated block has an R value between R1 and R72, depending on the material utilized in the core and as the siding.

Figure 2:
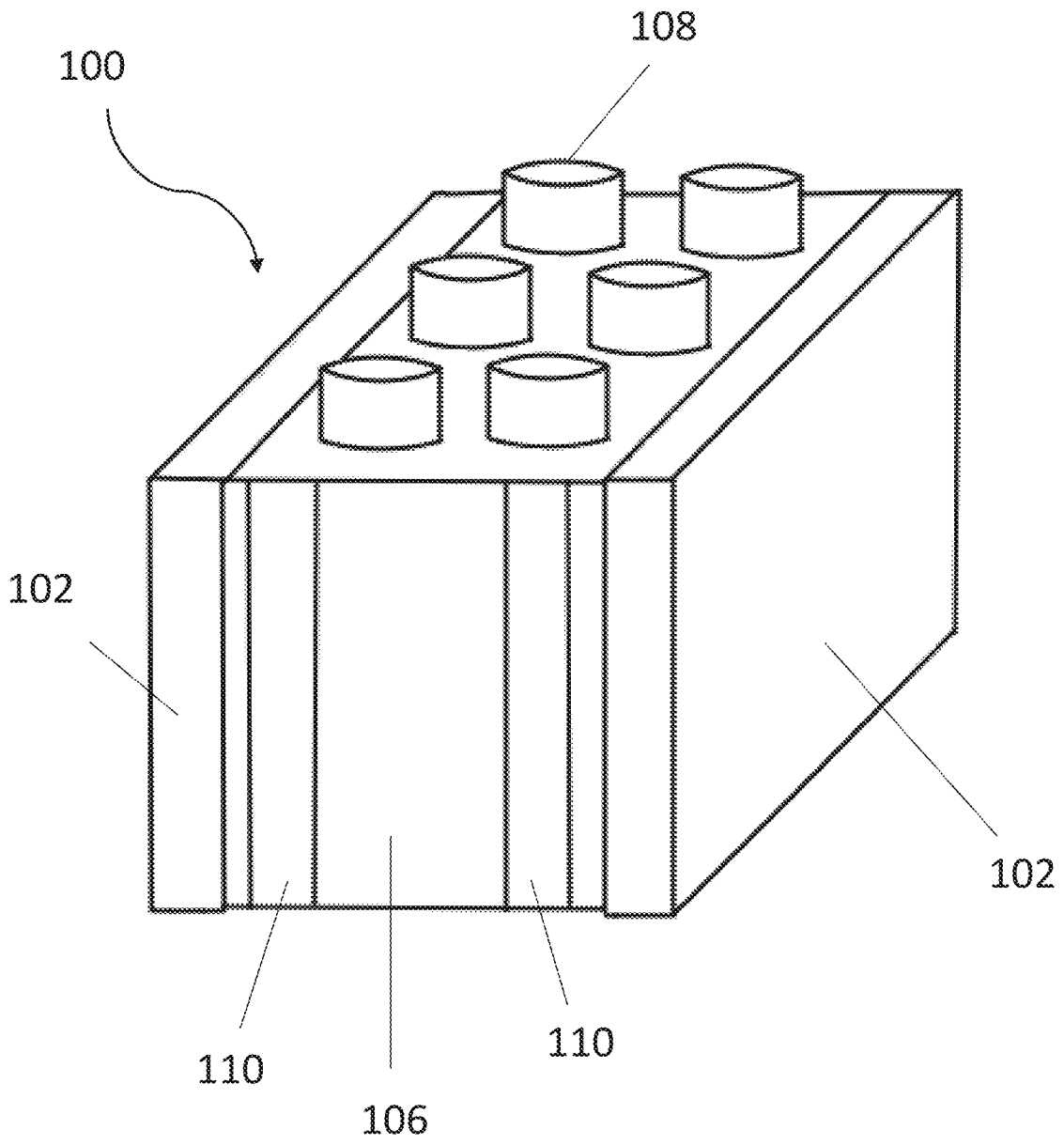
FIG. 2 illustrates a side perspective view of an insulated block according to one embodiment of the present invention.

FIG. 2 illustrates a side perspective view of an insulated block according to one embodiment of the present invention. FIG. 2 includes sides 102 which do not include tongues or grooves, but which rather have flat or substantially flat tops.

Figure 3:
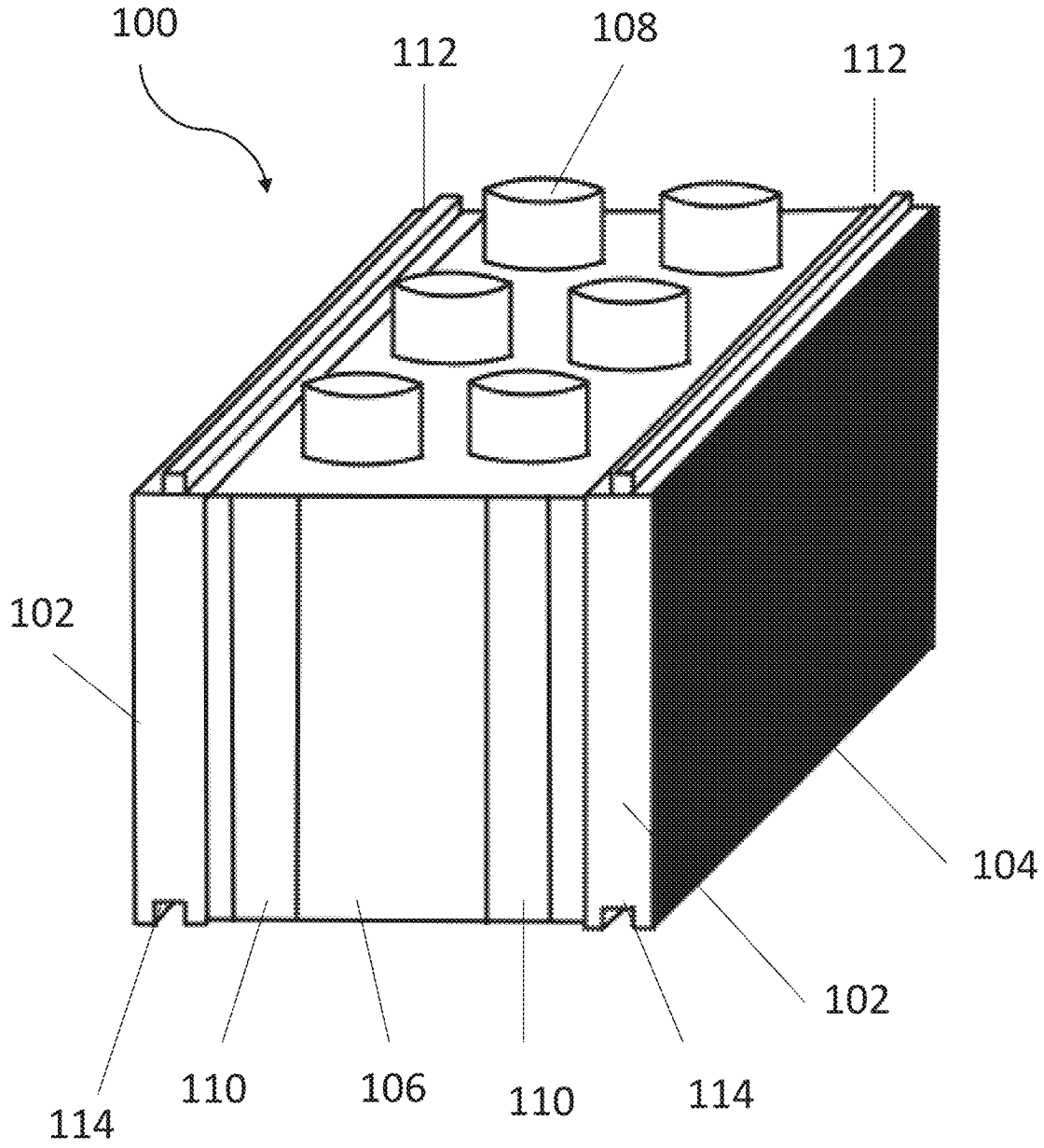
FIG. 3 illustrates a side perspective view of an insulated block according to another embodiment of the present invention.

FIG. 3 illustrates a side perspective view of an insulated block according to another embodiment of the present invention. Advantageously, one side 102 of the insulated block 100 includes a face 104 joined to the side 102 via any chemical or physical attachment means. The face 104 is operable to be decorative, such as plaster, sheetrock, stone, etc., or functional, such as a weather resistant barrier. In another embodiment, the face 104 is a coating.

Figure 4A:
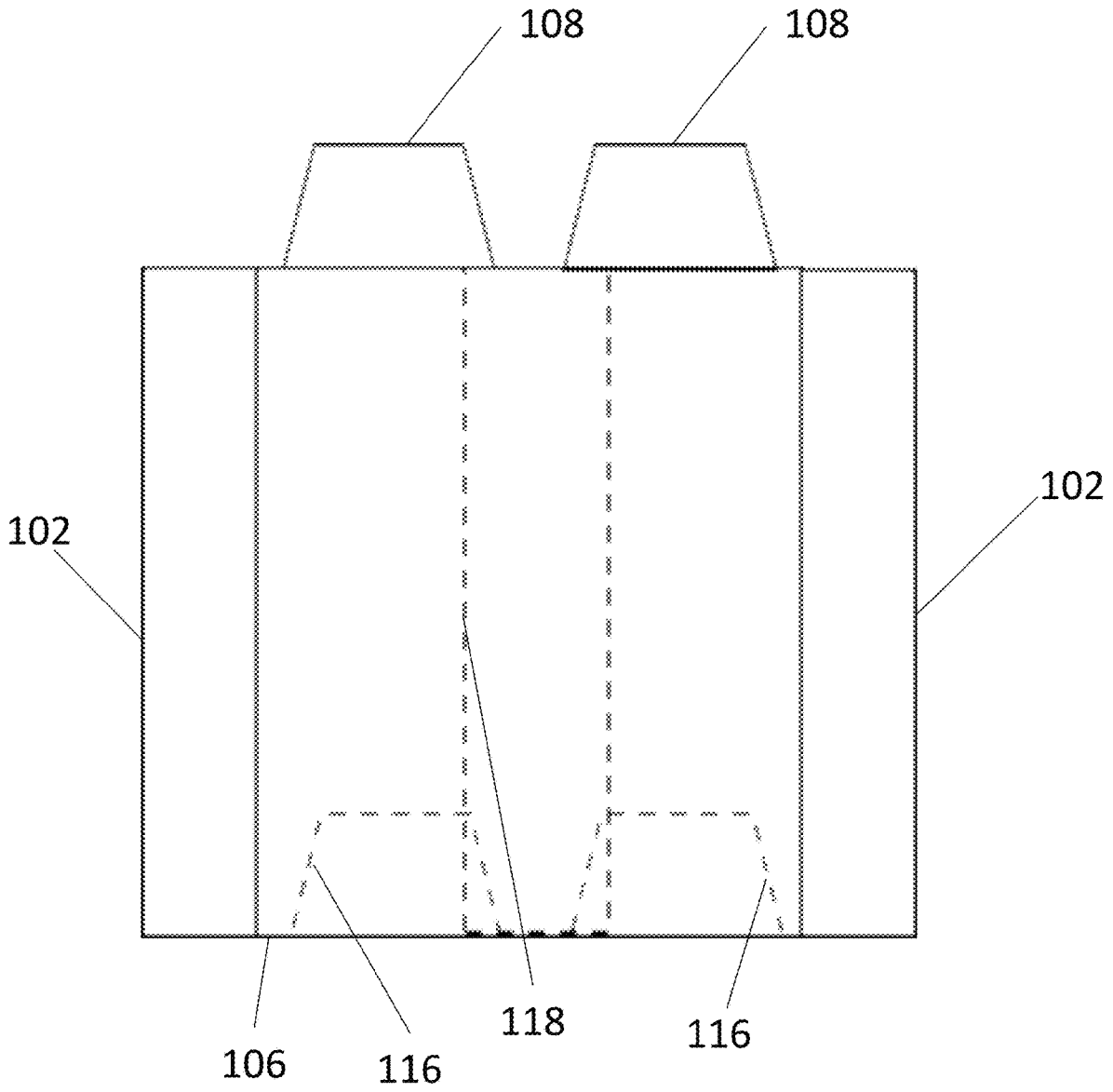
FIG. 4A illustrates a side transparent orthogonal view of an insulated block according to one embodiment of the present invention.

FIG. 4A illustrates a side transparent orthogonal view of an insulated block according to one embodiment of the present invention. The recessions 116 are included on the bottom of the foam core 106 of the insulated block 100 and are configured to receive protrusions from another insulated block. Preferably, the recessions are formed when the insulated block 100 is constructed by pumping foam into a space defined by the sides 102 and a mold or form. The insulated block 100 also includes a vertical interior chase 118 which provides a space in which structural support is operable to be included. The interior chase 118 preferably is positioned centrally or substantially centrally between the sides 102 in the foam core 106. The interior chase 118 is also preferably positioned approximately halfway between the center of the insulated block 100 and the edge of the foam core 106 of the insulated block 100 to facilitate insertion of a structural support through the insulated block 100 and other insulated blocks stacked on top of or underneath the insulated block 100. In one embodiment, the interior chase 118 is formed when the insulated block 100 is constructed by pumping foam into a space defined by the sides 102 and a mold or form. Alternatively, the interior chase 118 is formed by cutting the interior chase 118 out of the foam core 106. In one embodiment, the structural support includes grout or mortar. Alternatively, the insulated block does not include grout, mortar, or any other separate adhesive besides the polyurethane foam which acts as an adhesive as it cures to join the foam core to the sides of the insulated block. In other words, the polyurethane foam acts as a self-adhering or self-adhesing foam core. In another embodiment, the structural support includes a stabilizing metal rod or bar which is inserted into the interior chase 118. In one embodiment, the metal rod or bar is a steel rod or bar. Alternatively, the metal rod is an all-thread rod. The structural support is operable to be joined to the foam core via polyurethane foam, mortar, adhesive, grout, and/or any other chemical or physical means known in the art. Alternatively, the foam core includes reinforcing material such as metal rods or rebar positioned within a mold or form through which the block is created before the foam is added to the mold or form, thereby causing the metal bar to be joined with the polyurethane foam as it cures. However, a single insulated block by itself preferably does not include grout, mortar, or any other separate adhesive besides the polyurethane foam which acts as an adhesive as it cures to join the foam core to the sides of the insulated block. In another embodiment, the insulated block does not include metal components or does not include integrated metal components. In another embodiment, the interior chase 118 is configured to receive conduit, electrical wiring, wiring for transmission of data, plumbing, or any other functional or structural components.

Figure 4B:
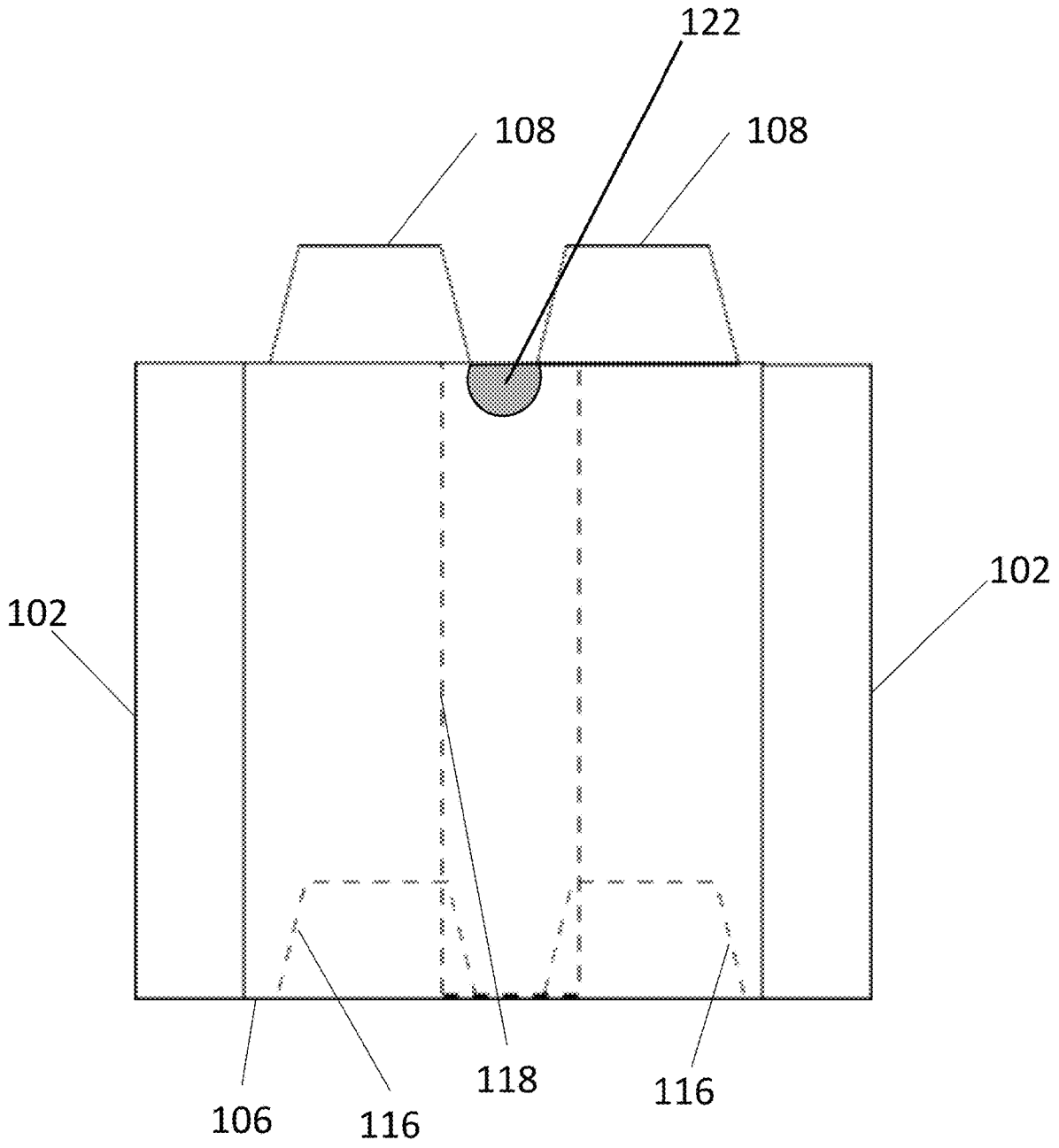
FIG. 4B illustrates a side transparent orthogonal view of an insulated block according to one embodiment of the present invention.

As shown in FIG. 4B, in some embodiments an insulated block includes a cavity 122. The cavity 122 allows stabilizing bars to be recessed into the insulated block. In some embodiments, the stabilizing bars recessed into the cavity 122 include rebar. In some embodiments, adjacent insulated blocks each include a cavity 122, with a single stabilizing bar recessed across multiple insulated blocks. In other embodiments, a stabilizing bar is recessed in a single insulated block and not recessed in surrounding insulated blocks.

Figure 4C:
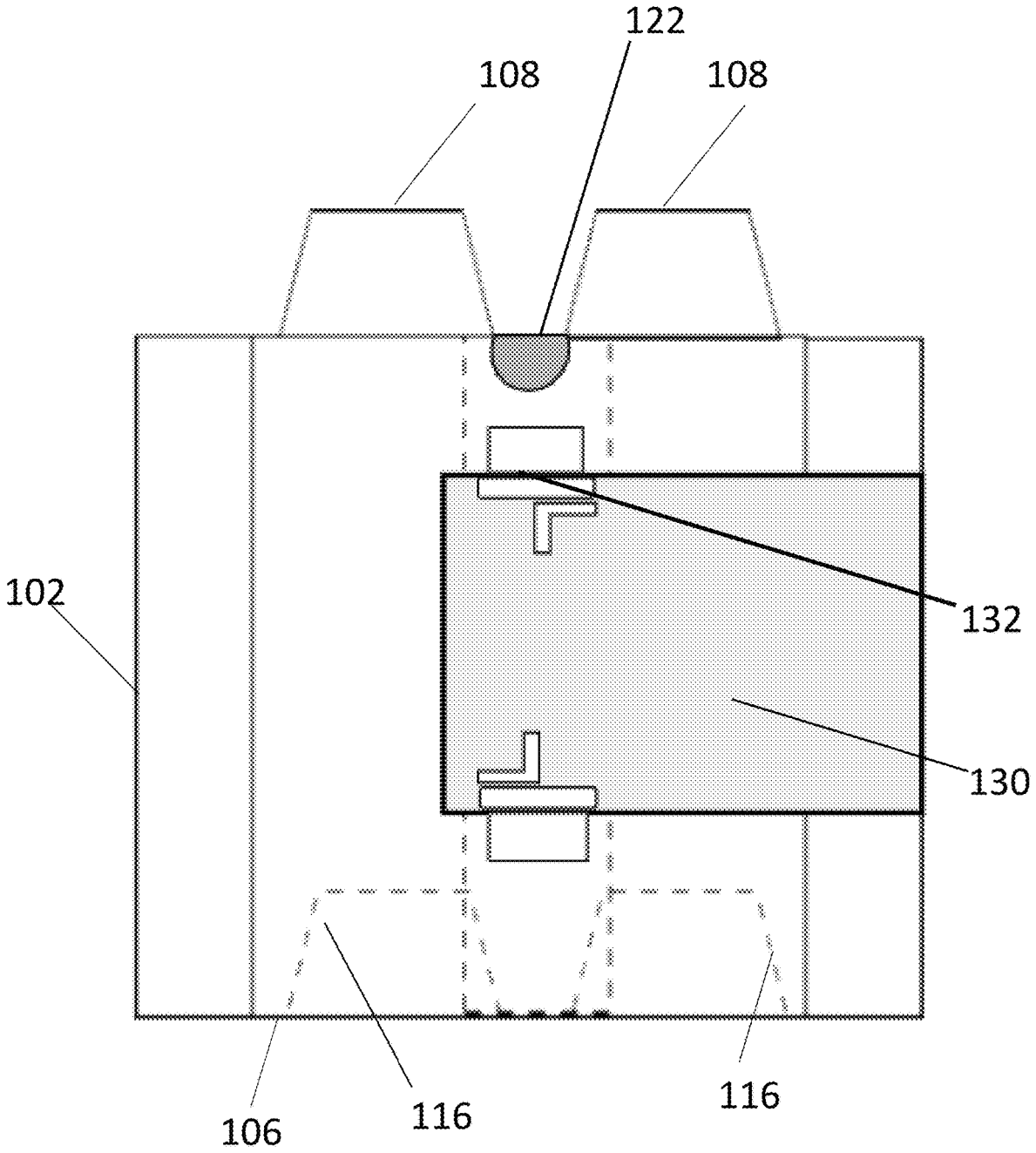
FIG. 4C illustrates a side transparent orthogonal view of an insulated block according to one embodiment of the present invention.

As shown in FIG. 4C, in some embodiments, an insulated block includes an interior space 130. In some embodiments, the interior space 130 includes a standard electrical box with electrical box connectors 132. In other embodiments, the interior space 130 includes housing for at least one sensor, at least one network hub, and/or at least one other electrical device. Alternatively, the at least one sensor, at least one network hub, and/or at least one electrical device is embedded in the foam core of the insulated block. In one embodiment, the foam of the insulated block is formed around the at least one sensor, at least one network hub, and/or at least one electrical device such that the foam does not need to be cut to insert the at least one sensor, at least one network hub, and/or at least one electrical device and the at least one sensor, at least one network hub, and/or at least one electrical device is completely surrounded by the foam. In another embodiment, at least one sensor, at least one network hub, and/or at least one electrical device which requires one or more gaps for functionality or to prevent overheating is not completely embedded in the foam. Alternatively, the at least one sensor, at least one network hub, and/or at least one electrical device is positioned against a side of the block. In one embodiment, a face of the at least one sensor, at least one network hub, and/or at least one electrical device is flush with a side of the block with the foam of the block being formed around the remainder of the at least one sensor, at least one network hub, and/or at least one electrical device. In some embodiments, the at least one sensor includes wirelessly linked sensors over a network, such as BLUETOOTH, WIFI, or any other network type. Additionally and/or alternatively, the at least one sensor is operable to communicate with other sensors, at least one network hub, and/or at least one other electrical device via any communication protocol known in the art, including but not limited to radio frequency (RF), near field communication (NFC), etc. In some embodiments, the at least one sensor is capable of detecting a threatening event affecting a group of insulated blocks. Threatening events include, by way of example and not limitation, cracks forming in at least one insulated block, the detection of moisture within at least one insulated block, lateral displacement of at least one insulated block, vibration within at least one insulated block, or other events threatening the integrity of an insulated block and/or a grouping of insulated blocks.

Figure 4D:
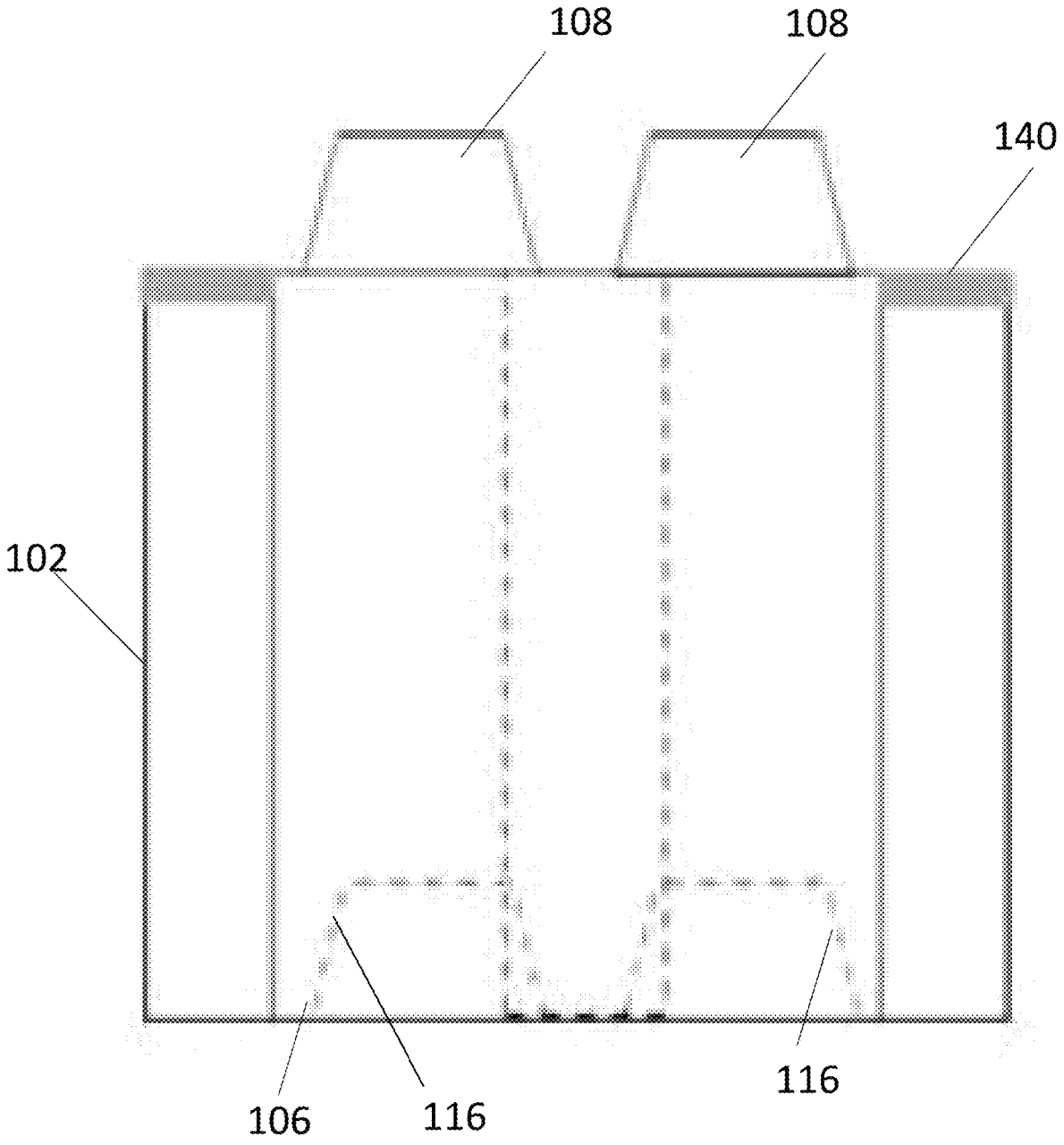
FIG. 4D illustrates a side transparent orthogonal view of an insulated block according to one embodiment of the present invention.

As shown in FIG. 4D, in some embodiments, an insulated block includes at least one gasket 140. In some embodiments, the gasket 140 includes polyurethane or another closed cell material. The inclusion of the gasket 140 allows for decreased contact between the concrete sidings of adjacent insulated blocks. Decreased direct contact between the concrete sidings enhances the durability of the insulated blocks, especially in the event of an earthquake or other events that cause a structure to shake. The gasket 140 therefore will help prevent the propagation of cracks through the rigid concrete material that would normally form across a concrete block wall.

The insulated blocks of the present invention are operable to be any shape and size to fit the need for a foundation or structure. By way of example, top insulated blocks are utilized which do not include protrusions on the top of the insulated block and include a top side covering the top of the foam core, analogous to the sides pictured in FIG. 1, 2, or 3. The top side is configured to be made out of any material recited herein or known in the art. A corner insulated block includes a foam core and four sides. Other blocks include window blocks which include openings for windows in the block or across multiple blocks, door blocks which include openings for doors in the blocks or across multiple blocks, and side blocks. Half blocks are also utilized, with half blocks being half the length of standard blocks of the present invention. Floor blocks are also operable to be utilized in one embodiment of the present invention.

Figure 5:
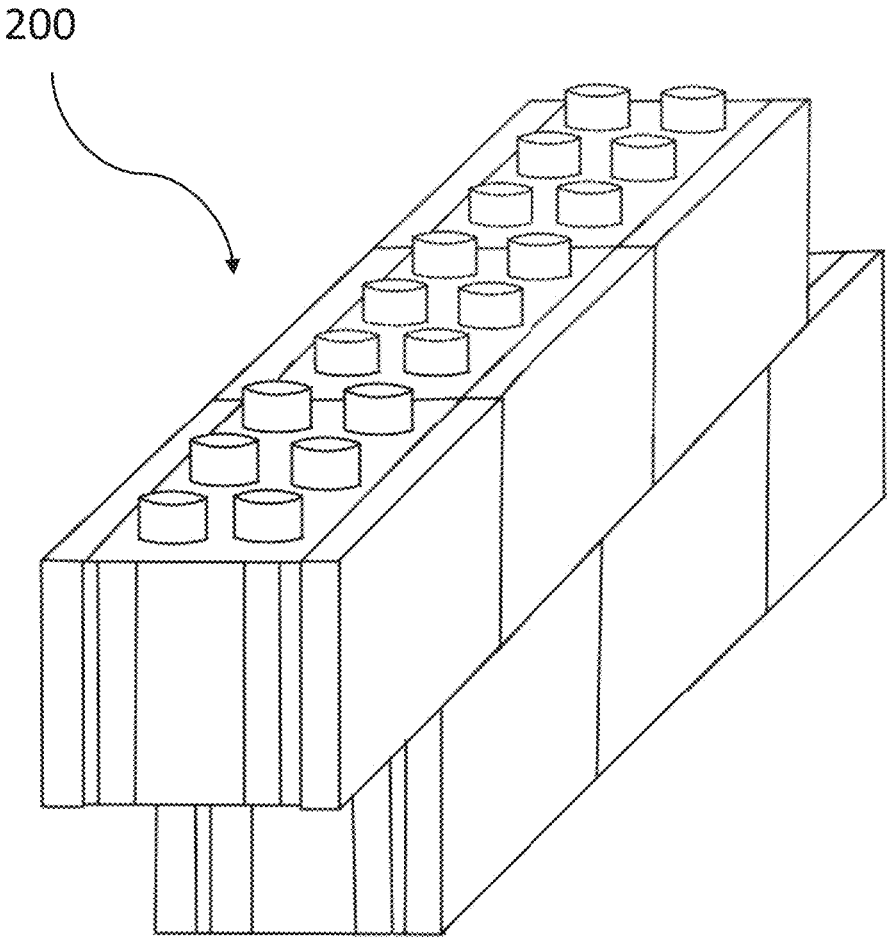
FIG. 5 illustrates a side perspective view of two rows of three insulated blocks according to one embodiment of the present invention.

FIG. 5 illustrates a side perspective view of two rows of three insulated blocks 200 according to one embodiment of the present invention. The two rows of insulated blocks 200 are stacked such that the protrusions of the foam core from the bottom row of insulated blocks are inserted into the recessions of the foam core of the top row of the insulated blocks. The top row of insulated blocks is offset from the bottom row of insulated blocks such that two protrusions of a first insulated block on the bottom row of insulated blocks are inserted into two recessions of a second block in the top row of insulated blocks and four protrusions from the first insulated block on the bottom row of insulated blocks are inserted into four recessions of a third block in the top row of insulated blocks. Advantageously, the rows of insulated blocks are configured to be joined without grout, mortar, or any other separate adhesive besides the polyurethane foam which acts as an adhesive as it cures to join the foam core to the sides of each insulated block. In other words, the rows of insulated blocks provide a mortarless block wall system or mortarless foundation, or a block wall system or foundation which does not include separate adhesive to join together the blocks or components of the blocks. Alternatively, an adhesive including adhesive including clay, cement, acrylic resin, polyurethane monomers, and/or styrene-butadiene rubber is utilized to adhere blocks together for additional stability. In another embodiment, the rows of insulated blocks do not include metal components or do not include integrated metal components.

In yet another embodiment, the insulated block includes clips which are inserted as blocks are assembled. These clips provide for additional siding materials to be attached to the blocks, either on an external side of a structure or on an internal side of a structure.

In one embodiment, the insulated blocks do not include a chase or other opening or gap in the foam core besides the recessions for accepting protrusions from other blocks, the space between the protrusions, and any space between components on the side of the block such as tongues or grooves which facilitate joining a block with another block. In some embodiments, the block includes a groove. The groove includes a dovetail groove, a bevel groove, a V groove, a double V groove, a J groove, or any other type of groove.

Notably, when assembled, the insulated blocks provide six different "barriers" for a wall or structure. Specifically, the insulated blocks provide a physical barrier in that the insulated blocks are structurally strong and of sufficient strength for the intended purpose of supporting loads, including compressive, lateral, shear, and transverse loads. The assembled blocks also provide a thermal insulated barrier due to the continuous or substantially continuous layers of polyurethane foam provided when the foam cores of the blocks are joined together. The continuous or substantially continuous layers of polyurethane foam also acts as a moisture barrier to keep moisture from permeating through the assembled blocks, as closed cell foam such as polyurethane does not absorb moisture or water. Significantly, the continuous or substantially continuous layers of polyurethane foam also enables the assembled blocks to act as a vapor barrier to keep humidity and condensation from permeating the assembled blocks. The assembled blocks also provide an air barrier or air tight system which prevents the movement of air through the assembled blocks by virtue of the fact that the assembled blocks do not include any gaps through which air flows through. Finally, the assembled blocks provide a fire barrier, regardless of the type of siding joined to the polyurethane foam core. The closed cell polyurethane foam core of the present invention is fire-retardant and therefore prevents fire from burning through the continuous or substantially continuous layers of polyurethane foam layer created when the blocks are assembled, even if one side of the blocks is burned or charred. The polyurethane foam of the present invention advantageously never melts. Notably, this is particularly advantageous in wildfire prone areas of the country such as California. Polystyrene foam is not fire retardant, and building materials which utilize polystyrene therefore do not provide a fire retardant or fire resistant envelope for a foundation or a building, as polystyrene is a thermoplastic material which has a transition temperature of around 100° C. (212° F.). Even if polystyrene were included in a core of a structural block, heat applied to the sides of a block could cause the polystyrene core to melt and therefore the structure to fail.

Figure 6:
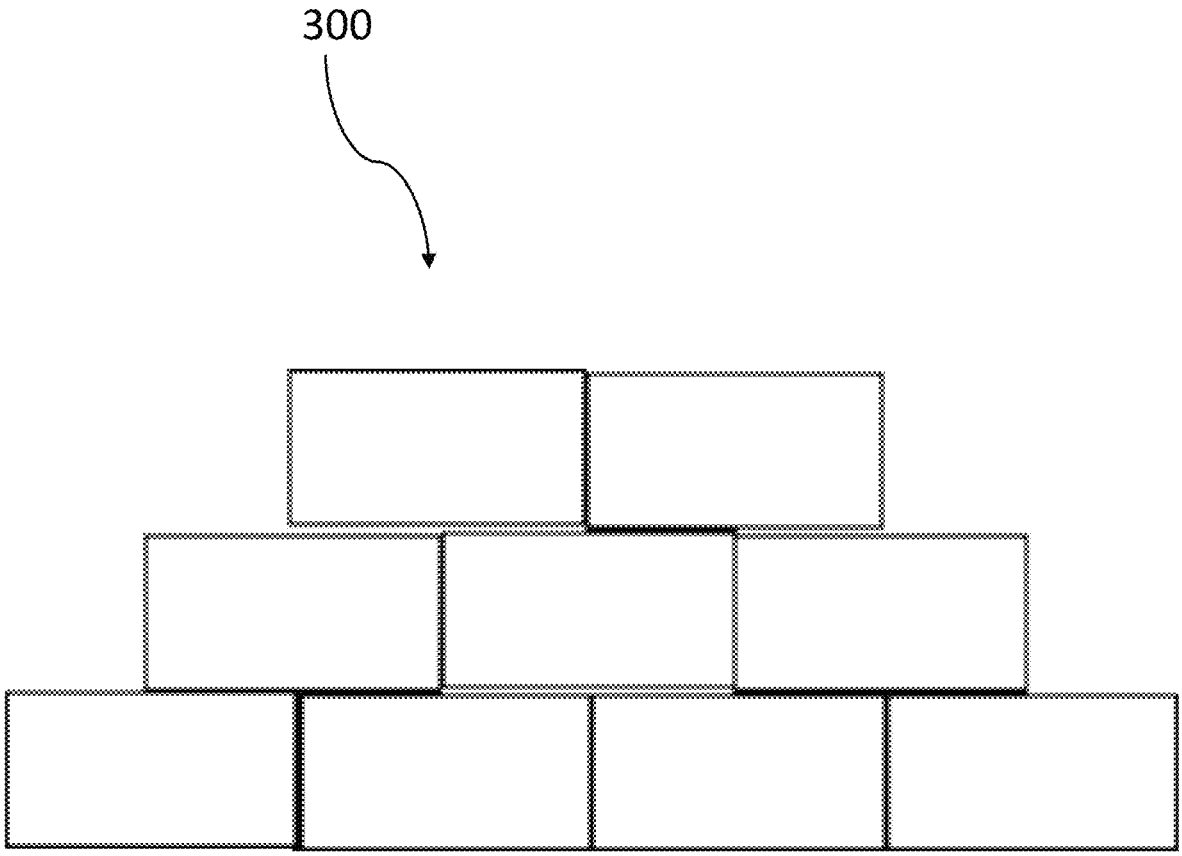
FIG. 6 illustrates a front orthogonal view of three rows of insulated blocks according to one embodiment of the present invention.

FIG. 6 illustrates a front orthogonal view of three rows of insulated blocks 300 according to one embodiment of the present invention. Each row of insulated blocks is offset approximately one half of a block length from the row immediately above or below the row of insulated blocks.

Figure 7:
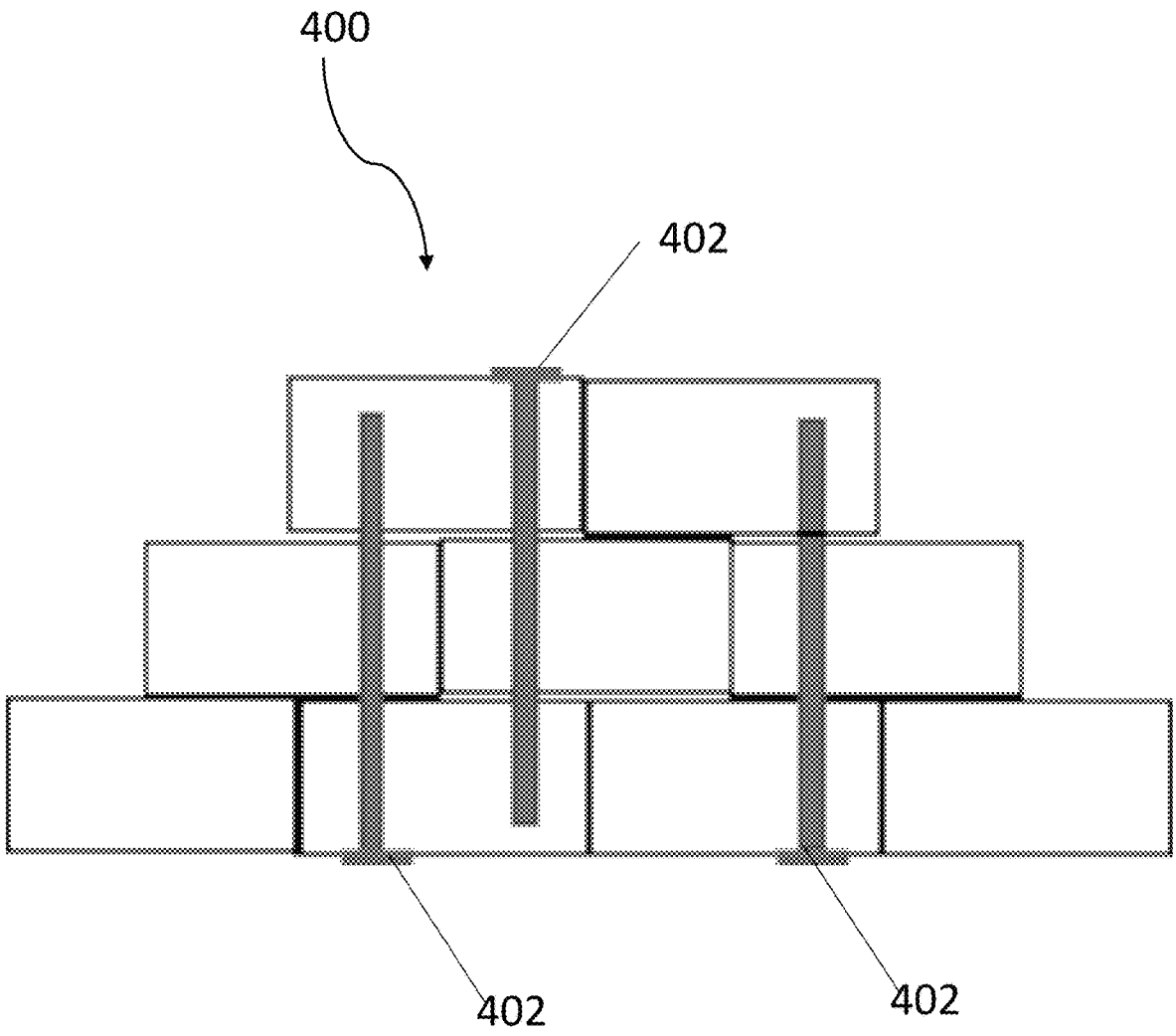
FIG. 7 illustrates a front transparent orthogonal view of three rows of insulated blocks with stabilizing bars according to one embodiment of the present invention.

FIG. 7 illustrates a front transparent orthogonal view of three rows of insulated blocks with stabilizing bars 400 according to one embodiment of the present invention. The stabilizing bars 402 or stabilizing rods are inserted through interior chases in the rows of insulated blocks and provide structural support to the rows of insulated blocks. The stabilizing bar 402 includes a long stem perpendicularly connected to an arm. In one embodiment, the length of a stabilizing bar 402 is approximately equivalent to the height of three insulated blocks. Alternatively, the length of a stabilizing bar 402 is approximately equivalent to the height of two insulated blocks. The stabilizing bars 402 are added to the rows of insulated blocks as the insulated blocks are assembled, and foam, mortar, adhesive, grout, and/or any other chemical or physical means known in the art is used to secure the stabilizing bars 402 to the interior chases of the blocks, preferably filling all space between the stabilizing bar 402 and the foam core of the insulated block.

Figure 8A:
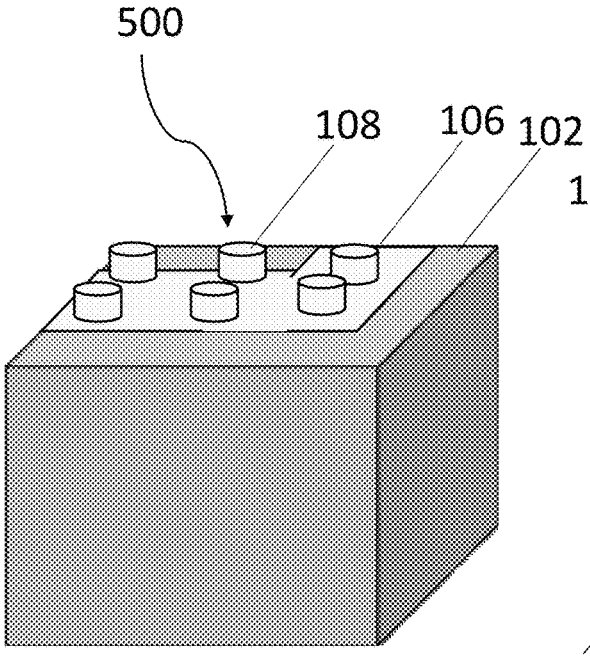
FIG. 8A illustrates an isometric view of an insulated corner block according to one embodiment of the present invention.
Figure 8B:
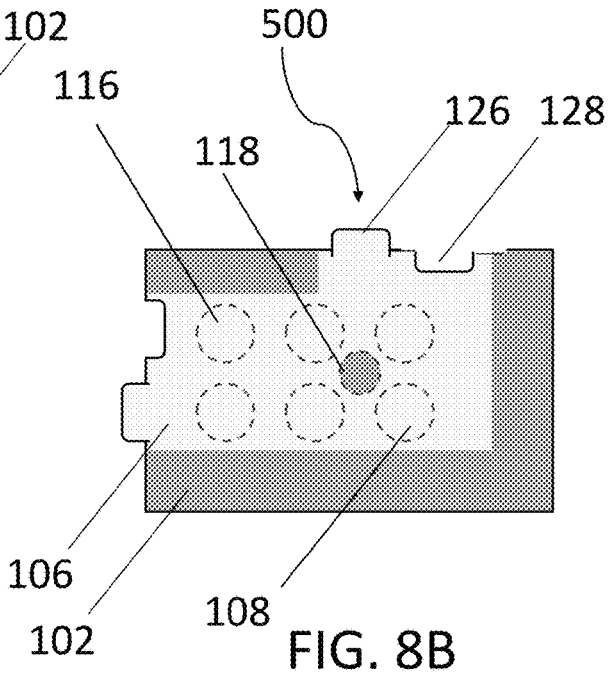
FIG. 8B illustrates a top view of the insulated corner block depicted in FIG. 8A.

FIG. 8A shows an isometric view of an insulated corner block 500 according to one embodiment of the present invention. In one embodiment, the insulated corner block 500 serves as a right-handed corner piece for a construction of insulated blocks. The insulated corner block 500 includes one or more protrusions 108 for connection to one or more recessions 116 as shown in FIB. 8B, in additional insulated blocks, including additional right-handed corner blocks 500 and insulated blocks having different geometries, such as the insulated block 100 shown in FIG. 1. As shown in FIG. 8B, in some embodiments, the insulated corner block 500 includes paired horizontal extensions 126 and recesses 128 on two sides. The paired horizontal extensions 126 and recesses 128 are configured to allow for interconnection between the insulated corner block 500 and other insulated blocks with similar or different geometries. In some embodiments, the insulated corner block 500 includes one or more recessions 116 for accepting protrusions 108 of other insulated blocks. In other embodiments, the insulated corner block 500 lacks any recessions 116. In some embodiments, the insulated corner block 500 includes an interior chase 118 for the inclusion of stabilizing bars. In some embodiments, stabilizing bars inserted into the interior chase 118 include rebar.

Figure 9A:
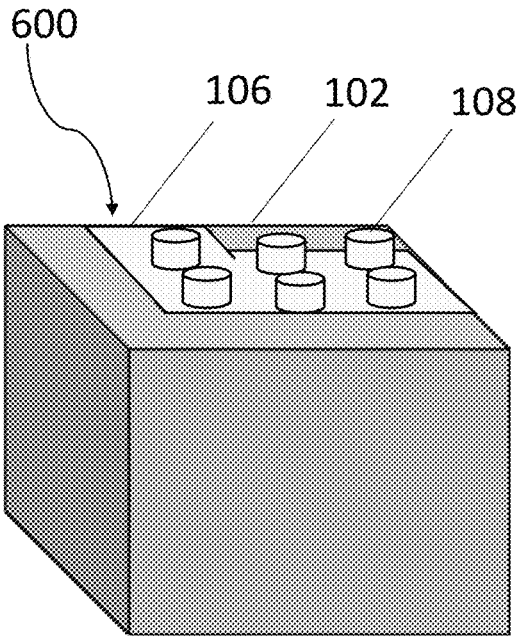
FIG. 9A illustrates an isometric view of an insulated corner block according to one embodiment of the present invention.
Figure 9B:
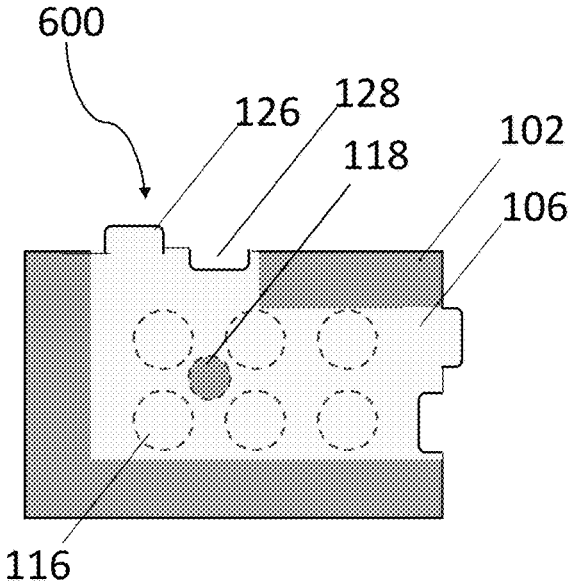
FIG. 9B illustrates a top view of the insulated corner block depicted in FIG. 9A.

FIG. 9A shows an isometric view of an insulated corner block 600 according to one embodiment of the present invention. In one embodiment, insulated corner block 600 serves as a left-handed corner piece for a construction of insulated blocks. Insulated corner block 600 includes one or more protrusions 108 for connection to one or more recessions 116, as shown in FIG. 9B, in additional insulated blocks, including additional left-handed corner blocks 600 and insulated blocks having different geometries, such as the insulated block 100 shown in FIG. 1. As shown in FIG. 9B, in some embodiments, the insulated corner block 600 includes paired horizontal extensions 126 and recesses 128 on two sides. The paired horizontal extensions 126 and recesses 128 are configured to allow for interconnection between the insulated corner block 600 and other insulated blocks with similar or different geometries. In some embodiments, the insulated corner block 600 includes one or more recessions 116 for accepting one or more protrusions 108 of other insulated blocks. In other embodiments, the insulated corner block 600 lacks any recessions 116. In some embodiments, the insulated corner block 600 includes an interior chase 118 for the inclusion of stabilizing bars. In some embodiments, stabilizing bars inserted into the interior chase 118 include rebar.

Figure 10A:
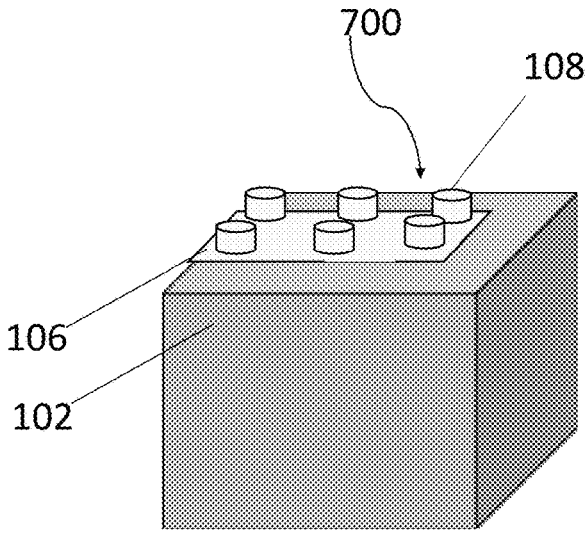
FIG. 10A illustrates an isometric view of an insulated hard cap block according to one embodiment of the present invention.
Figure 10B:
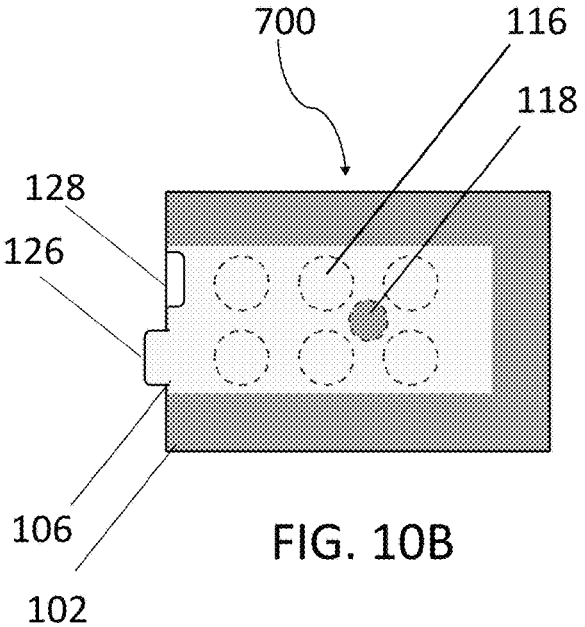
FIG. 10B illustrates a top view of the insulated hard cap block depicted in FIG. 10A.
Figure 10C:
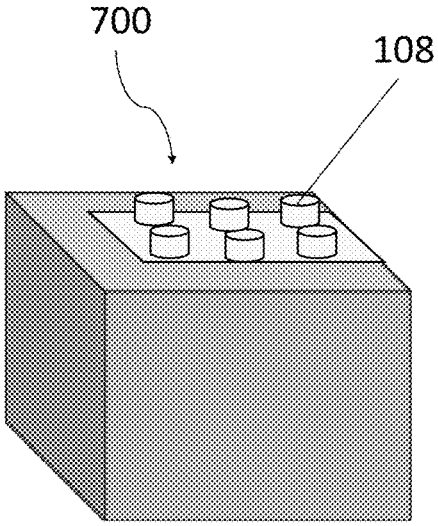
FIG. 10C illustrates another isometric view of the insulated hard cap block depicted in FIG. 10A.
Figure 10D:
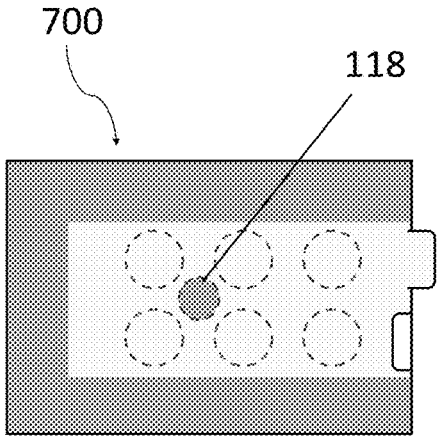
FIG. 10D illustrates another top view of the insulated hard cap block depicted in FIG. 10A.

FIGS. 10A and 10C show isometric views of an insulated hard cap block 700 according to one embodiment of the present invention. In one embodiment, insulated hard cap block 700 is a hard cap piece and serves as the final block at the end of a row of insulated blocks. The foam core of insulated hard cap block 700 is surrounded on three sides by siding 102. Insulated hard cap block 700 includes protrusions 108 for connection to corresponding recessions 116, as shown in FIG. 10B, in additional insulated blocks layered on top of insulated hard cap block 700. In some embodiments, insulated hard cap block 700 is the final block in a row of blocks in the vicinity of a door frame or window frame of a structure. As shown in FIGS. 10B and 10D, in some embodiments, insulated hard cap block 700 includes paired horizontal extensions 126 and recesses 128 on one side. The paired horizontal extensions 126 and recesses 128 allow for interconnection between insulated hard cap block 700 and other insulated blocks with similar or different geometries. In some embodiments, the insulted hard cap block 700 includes one or more recessions 116 for accepting one or more protrusions 108, as shown in FIG. 10A, of other insulated blocks. In some embodiments, the insulated hard cap block 700 includes an interior chase 118 for the inclusion of stabilizing bars. In some embodiments, stabilizing bars inserted into the interior chase 118 include rebar.

Figure 11A:
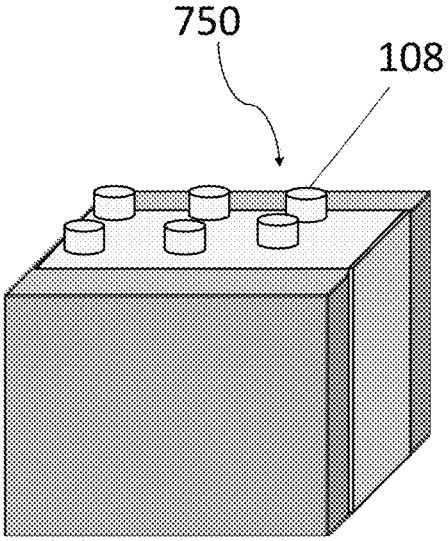
FIG. 11A illustrates an isometric view of an insulated soft cap block according to embodiment of the present invention.
Figure 11B:
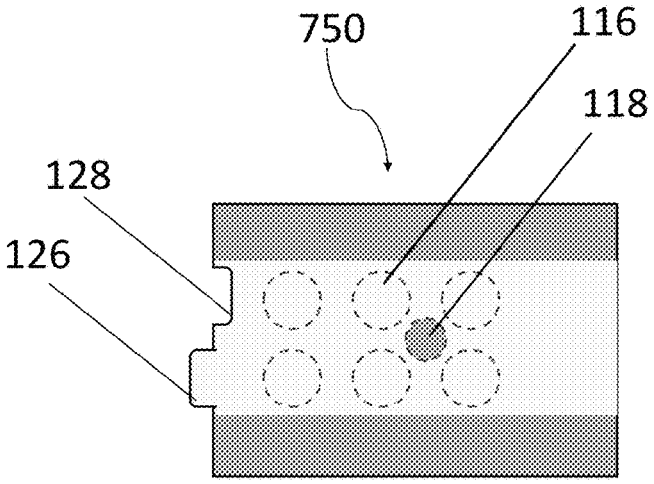
FIG. 11B illustrates a top view of the insulated soft cap block depicted in FIG. 11A.
Figure 11C:
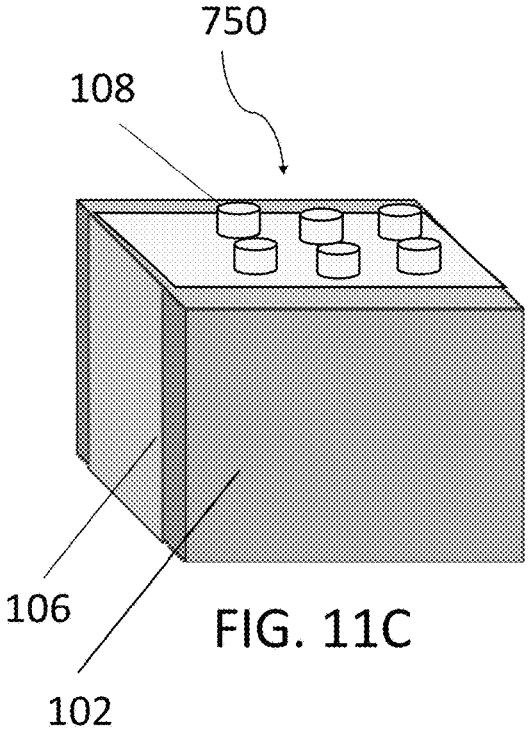
FIG. 11C illustrates an isometric view of the insulated soft cap block depicted in FIG. 11A.
Figure 11D:
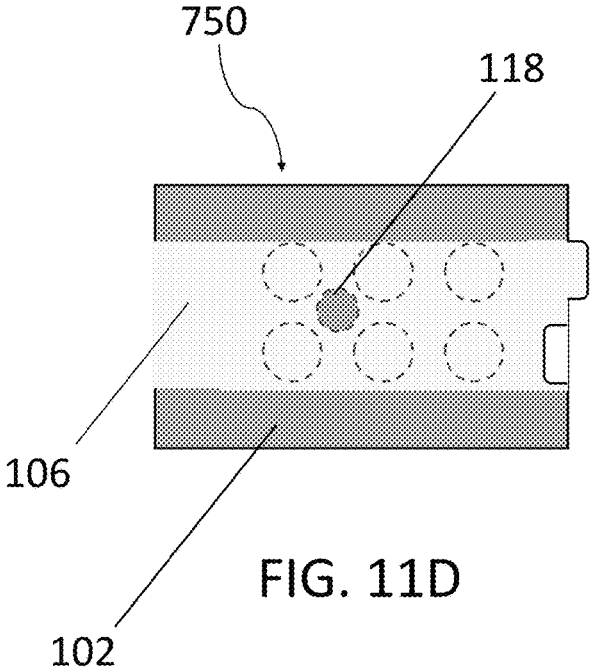
FIG. 11D illustrates a top view of the insulated soft cap block depicted in FIG. 11A.

FIGS. 11A and 11C show isometric views of an insulated soft cap block 750 according to one embodiment of the present invention. In one embodiment, insulated soft cap block 750 is a soft cap piece and serves as the final block at the end of a row of insulated blocks. The foam core of insulated soft cap block 750 is surrounded on two sides by siding. Insulated soft cap block 750 includes protrusions 108 for connection to corresponding recessions 116, as shown in FIG. 11B, in additional insulated blocks layered on top of insulated soft cap block 750. In some embodiments, insulated soft cap block 750 is the final block in a row of blocks in the vicinity of a door frame or window frame of a structure. As shown in FIGS. 11B and 11D, in some embodiments, insulated soft cap block 750 includes paired horizontal extensions 126 and recesses 128 on one side. The paired horizontal extensions 126 and recesses 128 allow for interconnection between insulated soft cap block 750 and other insulated blocks with similar or different geometries. In some embodiments, the insulted soft cap block 750 includes one or more recessions 116 for accepting one or more protrusions 108, as shown in FIG. 11A, of other insulated blocks. In some embodiments, the insulated soft cap block 750 includes an interior chase 118 for the inclusion of stabilizing bars. In some embodiments, stabilizing bars inserted into the interior chase 118 include rebar.

Figure 12:
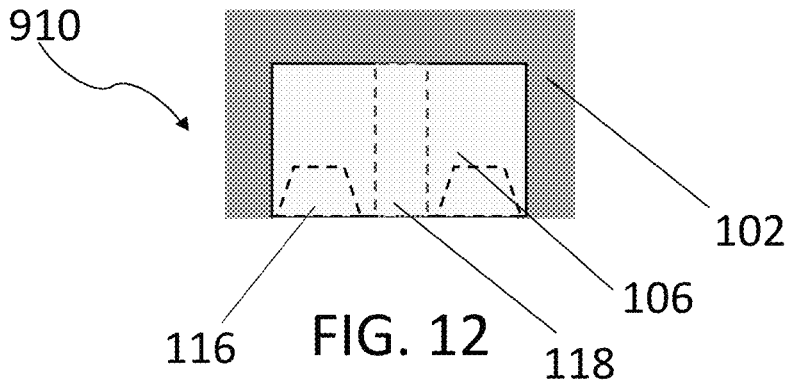
FIG. 12 illustrates a front transparent orthogonal view of a top insulated hard cop block according to one embodiment of the present invention.

FIG. 12 shows a front transparent orthogonal view of an top insulated hard cap block 910 according to one embodiment of the present invention. In one embodiment, the top insulated hard cap insulated block 910 serves as the final block at the top or bottom of a column of insulated blocks. The top or bottom of top insulated hard cap block 910 is covered with protective siding, while the opposite side includes exposed foam core. In some embodiments, the top insulated hard cap block 910 includes one or more recessions 116 for connection to corresponding protrusions in additional insulated blocks. In other embodiments, the top insulated hard cap block 910 lacks any recessions 116 and includes one or more protrusions for connection to corresponding recessions in additional insulated blocks. In some embodiments, the top insulated hard cap block 910 includes paired horizontal extensions and recessions on one or more sides. These horizontal extensions and recessions allow for interconnection with other insulated blocks having similar or different geometries. In some embodiments, the top insulated hard cap block 910 includes an interior chase 118 for the inclusion of stabilizing bars. In some embodiments, stabilizing bars inserted into the interior chase 118 include rebar.

Figure 13:
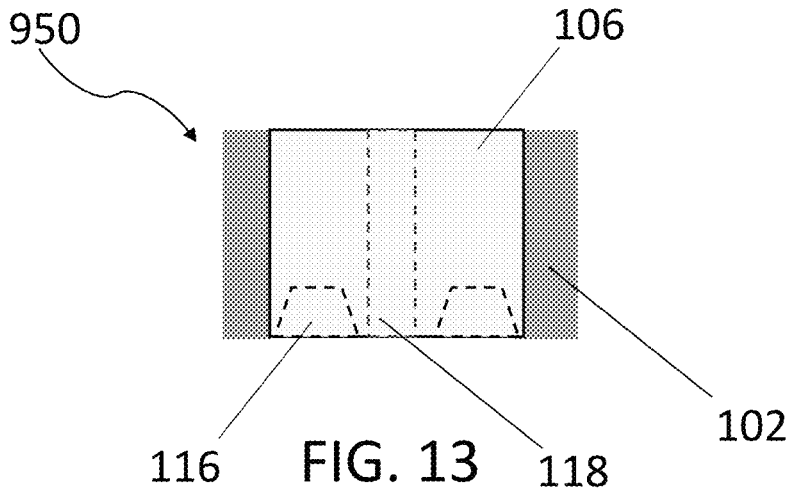
FIG. 13 illustrates a front transparent orthogonal view of a top insulated soft cap block according to one embodiment of the present invention.

FIG. 13 shows a front transparent orthogonal view of a top insulated soft cap block 950 according to one embodiment of the present invention. In one embodiment, the top insulated soft cap block 950 serves as the final block at the top or bottom of a column of insulated blocks. Neither the top nor bottom of the top insulated soft cap block 950 is fully covered with siding. In some embodiments, the top insulated soft cap block 950 includes one or more recessions 116 for connection to corresponding protrusions in additional insulated blocks. In other embodiments, the top insulated soft cap block 950 lacks any recessions 116 and includes one or more protrusions for connection to corresponding recessions in additional insulated blocks. In some embodiments, the top insulated soft cap block 950 includes paired horizontal extensions and recessions on one or more sides. These horizontal extensions and recessions allow for interconnection with other insulated blocks having similar or different geometries. In some embodiments, the top insulated soft cap block 950 includes an interior chase 118 for the inclusion of stabilizing bars. In some embodiments, interior chase 118 extends through the entirety of the height of the top insulated soft cap block 950. In some embodiments, stabilizing bars inserted into the interior chase 118 include rebar.

Figure 14:
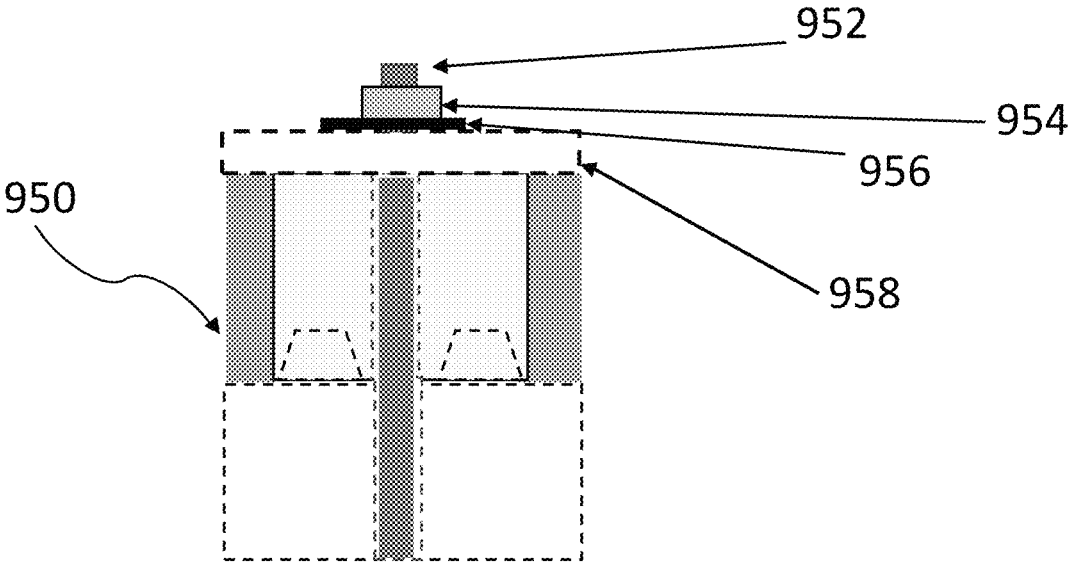
FIG. 14 illustrates a front transparent orthogonal view of a top insulated soft cap block according to one embodiment of the present invention.

As shown in FIG. 14, in another embodiment, the top insulated soft cap block 950 is connected to a pressure-treated wooden plate 958 by means of a compression rod 952 inserted through the wooden plate 958 and through the interior chase 118 of the top insulated soft cap block 950. In some embodiments, the compression rod 952 is secured by a nut 954 and a washer 956. In some embodiments, the compression rod 952 is anchored to a foundation slab of a structure.

In another embodiment, the insulated blocks include a horizontal interior chase which runs from one end of the foam core of the block and through the length of the block to the other end of the foam core of the block. The horizontal interior chase is configured to receive any component that the vertical interior chase is configured to receive. In one embodiment, the insulated block includes a vertical interior chase and a horizontal interior chase.

In the event of a collapse of an existing structure with a concrete slab foundation, the aforementioned insulated blocks are operable to be used to reconstruct the structure quickly and without the use of experienced construction crews. Furthermore, the use of the aforementioned insulated blocks to reconstruct the structure allows for re-use of existing plumbing and electrical stub-outs, allowing for increased ease in reconstruction.

In yet another embodiment, the present invention includes a thermoelectric insulated block. The thermoelectric insulated block is configured to create electrical power based on the temperature difference between a first side of the insulated block and a second side of the insulated block. In one embodiment, the insulated block includes at least one of bismuth telluride, lead telluride, inorganic clathrates, silicon germanium, magnesium, and other similar thermoelectric generating materials. For example, and not limitation, the thermoelectric insulated block includes a thermoelectric component in the insulating core. The insulated block is configured to be positioned in the ground or on the ground so one side of the insulated block is exposed to external elements (e.g. sun) and the other side is exposed to the ground. The thermoelectric component is connected to both sides of the insulated block. The thermoelectric generator is further configured to generate power based on the temperature difference between the first side of the block and the second side of the block. In another embodiment, the insulated block further includes an energy storage component that is connected to the thermoelectric generator. Advantageously, this enables the thermoelectric insulated block to store the thermoelectric energy. In one embodiment, the foam is formed around the thermoelectric components such that the foam does not need to be cut for the thermoelectric components to be included in the block, and such that the foam completely surrounds the thermoelectric components.

Figure 15:
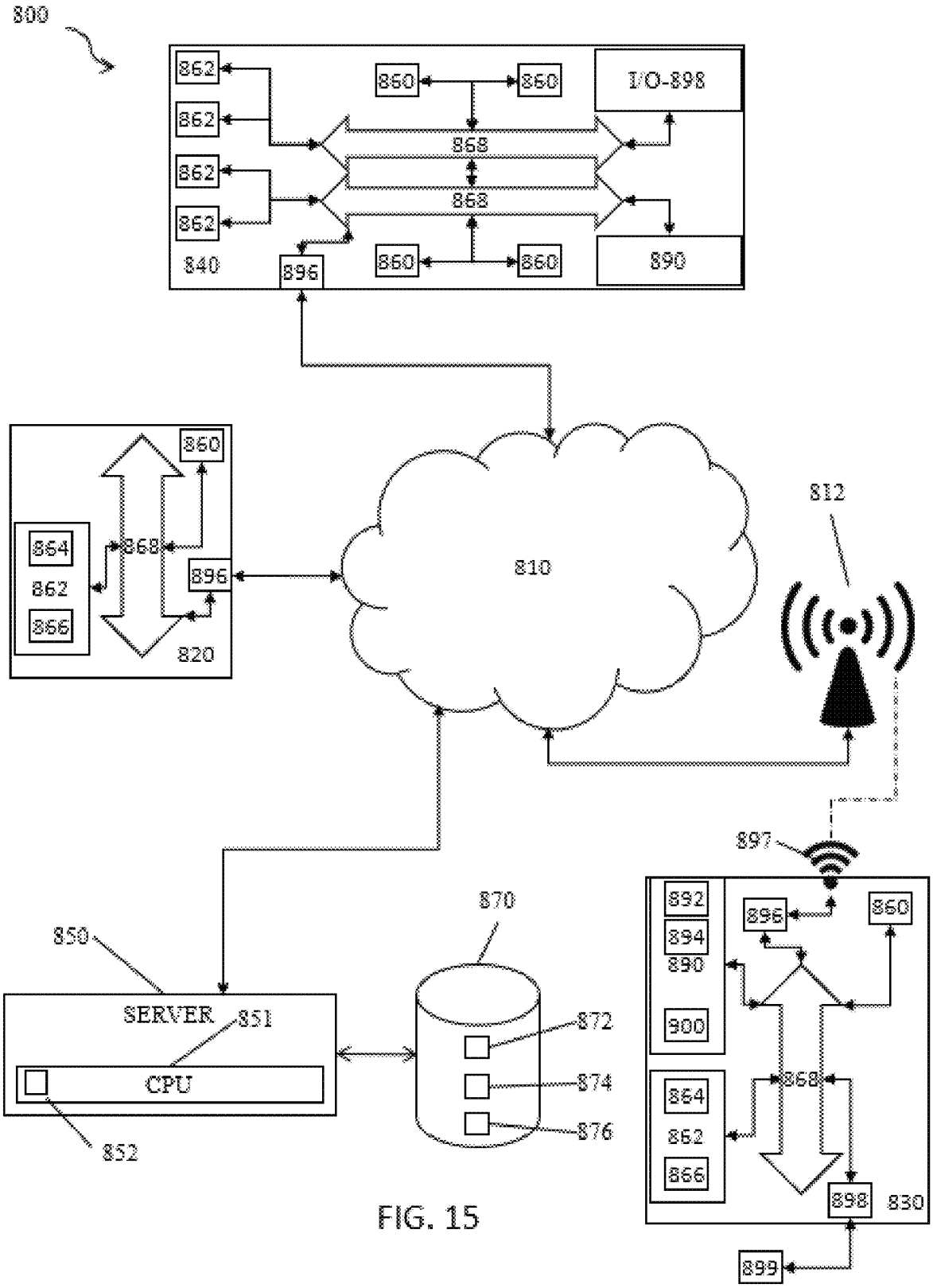
FIG. 15 is a schematic diagram of a system of the present invention.

FIG. 15 is a schematic diagram of an embodiment of the invention illustrating a computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, signal generation devices (e.g., speakers), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 15, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868.

Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 15, is operable to include other components that are not explicitly shown in FIG. 15, or is operable to utilize an architecture completely different than that shown in FIG. 15. The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

The above-mentioned examples are provided to serve the purpose of clarifying the aspects of the invention, and it will be apparent to one skilled in the art that they do not serve to limit the scope of the invention. By nature, this invention is highly adjustable, customizable and adaptable. The above-mentioned examples are just some of the many configurations that the mentioned components can take on. All modifications and improvements have been deleted herein for the sake of conciseness and readability but are properly within the scope of the present invention.

The invention claimed is:

1. An insulated block comprising:

a first vertical side comprising concrete;

a second vertical side comprising a composite material; and an insulating core including at least one multi-laminar protrusion and at least one multi-laminar recession on a side surface of the insulating core;

wherein the insulating core includes a plurality of cylindrical protrusions on a top surface of the insulating core configured to be received by a plurality of recessions of a second insulated block;

wherein the insulating core includes a plurality of cylindrical recessions on a bottom surface of the insulating core configured to receive a plurality of protrusions from a third insulated block;

wherein the plurality of cylindrical protrusions on the top surface of the insulating core are arranged in at least one row;

wherein the plurality of cylindrical recessions on the bottom surface of the insulating core are arranged in at least one row;

wherein the first vertical side and the second vertical side are adhesively bonded to the insulating core;

wherein the insulating core is recessed below a top of the first vertical side and a top of the second vertical side; and wherein the at least one multi-laminar recession is configured to receive at least one multi-laminar protrusion from the second insulated block.

2. The insulated block of claim 1, wherein the insulating core includes polyurethane foam.

3. The insulated block of claim 1, wherein the first vertical side includes at least one protrusion and at least one recession, wherein the second vertical side includes at least one protrusion and at least one recession.

4. The insulated block of claim 1, further comprising at least one electrical device embedded in the insulating core.

5. The insulated block of claim 4, wherein the at least one electrical device includes at least one sensor, wherein the at least one sensor is configured to detect moisture or temperature.

6. An insulated block comprising:

a first side comprising a first material;

a second side comprising a second material; and a core comprising a thermoset;

wherein the first side and the second side are adhesively bonded to the thermoset core;

wherein the thermoset core includes a plurality of cylindrical protrusions on a top surface of the thermoset core;

wherein the thermoset core includes a plurality of cylindrical recessions on a bottom surface of the thermoset core;

wherein the plurality of cylindrical protrusions on the top surface of the thermoset core are arranged in at least one row;

wherein the plurality of cylindrical recessions on the bottom surface of the thermoset core are arranged in at least one row;

wherein the thermoset core includes a multi-laminar tongue component on at least one vertical side of the thermoset core and a multi-laminar groove component on the at least one vertical side of the thermoset core;

wherein the multi-laminar groove component is configured to receive a multi-laminar tongue component from a vertical side of a thermoset core of a second insulated block; and wherein the thermoset core is recessed below a top of the first side and a top of the second side, wherein the first side and the second side are vertical sides of the insulated block.

7. The insulated block of claim 6, wherein the first side has an integrally formed tongue protruding vertically along the top of the first side, and wherein the second side has an integrally formed tongue protruding vertically along the top of the second side.

8. The insulated block of claim 6, wherein each of the first side and the second side includes an inner surface and an outer surface, wherein each inner surface has a higher coefficient of friction than each outer surface.

9. The insulated block of claim 6, wherein the first material includes concrete and the second material includes a composite material.

10. The insulated block of claim 6, further including a gasket, wherein the gasket is positioned around the multi-laminar tongue component, wherein the gasket comprises polyurethane.

11. The insulated block of claim 6, wherein the thermoset core includes at least one protrusion, wherein the at least one protrusion is configured to connect to at least one recession of a second insulated block.

12. The insulated block of claim 6, wherein the thermoset core includes an interior chase, wherein the interior chase is configured to receive a structural support, wherein the interior chase is positioned substantially central between the first side and the second side.

13. The insulated block of claim 6, further including a cavity, wherein the cavity is configured to receive at least one stabilizing component, wherein the stabilizing component includes rebar.

14. The insulated block of claim 6, further including a physical barrier, a thermal insulated barrier, a moisture barrier, a vapor barrier, a fire barrier, and an air barrier.

15. The insulated block of claim 6, wherein the thermoset core includes polyurethane foam.

16. The insulated block of claim 15, wherein the polyurethane foam core has an R-value between about R7 to about R72.

17. An insulated block comprising:

a first side;

a second side; and an insulating core including a plurality of cylindrical protrusions, a plurality of cylindrical recessions, and at least one vertical interior chase;

wherein the first side and the second side are adhesively bonded to the insulating core;

wherein the insulating core is recessed below the first side and the second side, wherein the first side and the second side are vertical sides of the insulated block;

wherein the plurality of cylindrical protrusions and the plurality of cylindrical recessions are arranged in at least one row;

wherein the plurality of cylindrical recessions are configured to receive a plurality of cylindrical protrusions from a second insulated block;

wherein the vertical interior chase is configured to receive a structural support, wherein the vertical interior chase is positioned substantially central between the first side and the second side;

wherein the insulating core includes at least one multi-laminar edge, wherein the multi-laminar edge includes a male component and a female component, wherein the female component is configured to receive a male component of a second insulated block;

wherein the male component is a rectangular shaped protrusion on a vertical side surface of the insulating core and the female component is a rectangular shaped recession on the vertical side surface of the insulating core; and wherein the male component and the female component are configured to provide friction-based locking of the insulated block with the second insulated block.

18. The insulated block of claim 17, wherein the first side comprises a first material, wherein the second side comprises a second material, wherein the first material includes concrete and the second material includes a composite material.

19. The insulated block of claim 17, further including an interior space, wherein the interior space includes a housing, wherein the housing is configured to receive at least one electrical device.

20. The insulated block of claim 17, wherein the insulating core has an R-value of about R-72.

* * * * *